US012173386B2

(12) United States Patent
Hussein et al.

(10) Patent No.: US 12,173,386 B2
(45) Date of Patent: Dec. 24, 2024

(54) ANTIMICROBIAL ALLOY OF TITANIUM, NIOBIUM, AND SILVER, AND METHOD OF PREPARATION THEREOF

(71) Applicant: KING FAHD UNIVERSITY OF PETROLEUM AND MINERALS, Dhahran (SA)

(72) Inventors: Mohamed Abdrabou Hussein, Dhahran (SA); Mohammed Abdul Azeem, Dhahran (SA); Arumugam Madhan Kumar, Dhahran (SA); Ahmad Asaad Sorour, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 18/312,268

(22) Filed: May 4, 2023

(65) Prior Publication Data

US 2024/0368735 A1 Nov. 7, 2024

(51) Int. Cl.

| | |
|---|---|
| ***C22C 14/00*** | (2006.01) |
| ***C22C 1/04*** | (2023.01) |
| ***C22F 1/18*** | (2006.01) |

(52) U.S. Cl.

CPC ..... *C22C 14/00* (2013.01); *C22C 1/0458* (2013.01); *C22F 1/183* (2013.01)

(58) Field of Classification Search

CPC ..... A61L 27/00; A61L 27/06; A61L 31/022; B22F 2003/1051; B22F 2009/041; B22F 2998/10; B22F 3/105; C22C 1/0458; C22C 14/00; C23F 11/04; C23F 11/10; C23F 11/122; C23F 11/149; C23F 11/16; C23F 11/185

See application file for complete search history.

(56) References Cited

U.S. PATENT DOCUMENTS

2005/0254990 A1* 11/2005 Tanaka ..... C22C 14/00 420/417

2011/0033335 A1 2/2011 Schiefer et al.

FOREIGN PATENT DOCUMENTS

CN 109022853 A 12/2018
CN 108300898 B 8/2020

(Continued)

OTHER PUBLICATIONS

NPL: Whole document of Sun et al., Martensite structure and mechanical properties of Ti—Nb—Ag shape memory alloys for biomedical application, Vacuum, 2018, vol. 156, pp. 181-186 (Year: 2018).*

(Continued)

*Primary Examiner* — Jie Yang

(74) *Attorney, Agent, or Firm* — Oblon, McClelland, Maier & Neustadt, L.L.P.

(57) ABSTRACT

An antimicrobial alloy includes titanium, niobium, and silver. Further, the antimicrobial alloy includes between 5 and 30 atomic percent niobium, up to 3 atomic percent silver, the remaining atomic percentage is titanium, and the alloy does not include zirconium. The antimicrobial alloy has a predominantly beta-titanium crystal structure and an elasticity modulus ranging from 60 to 85 GPa. A process for manufacturing the antimicrobial alloy. The antimicrobial alloy prepared by the method can be used in bioimplants.

6 Claims, 20 Drawing Sheets

(56) References Cited

FOREIGN PATENT DOCUMENTS

| | | | |
|---|---|---|---|
| CN | 113755718 | B | 7/2022 |
| CN | 115305384 | A | 11/2022 |

OTHER PUBLICATIONS

Shivaram et al. ; Development and Characterization of Biomedical Porous Ti—20Nb—5Ag Alloy: Microstructure, Mechanical Properties, Surface Bioactivity and Cell Viability Studies ; Metals and Materials International 28 ; Jan. 13, 2021 ; 11 Pages.

Du et al. ; Antibacterial Properties and Corrosion Resistance of the Newly Developed Biomaterial, Ti—12Nb—1Ag Alloy ; MDPI Metals, 7 ; Dec. 15, 207 ; 12 Pages.

Shivaram ; Development and Characterization of Biomedical Porous Ti—Nb—Ag Alloy through Powder Metallurgy Method ; National Institute of Technology Karnataka, Surathkal ; 2021 ; Abstract Only ; 3 Pages.

Sun et al. ; Martensite structure and mechanical property of TI—Nb—Ag shape memory alloys for biomedical applications ; Vacuum vol. 156 ; Oct. 2018 ; 6 Pages.

Hussein et al. ; Ti—30Nb—3Ag alloy with improved corrosion resistance and antibacterial properties for orthopedic and dental applications produced by mechanical alloying ; Journal of the Mechanical Behavior of Biomedical Materials 142 ; Apr. 13, 2023 ; 11 Pages.

Hussein et al. ; Design and processing of near-b TieNbeAg alloy with low elastic modulus and enhanced corrosion resistance for orthopedic implants ; Journal of Materials Research and Technology 24 ; Mar. 5, 2023 ; 15 Pages.

* cited by examiner

ANTIMICROBIAL ALLOY OF TITANIUM, NIOBIUM, AND SILVER, AND METHOD OF PREPARATION THEREOF

STATEMENT OF PRIOR DISCLOSURE BY AN INVENTOR

Aspects of the present disclosure are described in M. A. Hussein, M. A. Azeem, A. Madhan Kumar, S. Saravanan, N. Ankah, and A. A. Sorour; "Design and Processing of Near-β Ti—Nb—Ag Alloy with Low Elastic Modulus and Enhanced Corrosion Resistance for Orthopedic Implants;" J. Materials Research and Technology; Mar. 5, 2023; 24:259-273; incorporated herein by reference.

STATEMENT OF ACKNOWLEDGEMENT

Support provided by King Fahd University of Petroleum & Minerals (KFUPM) under grant number INAM2108 is gratefully acknowledged.

BACKGROUND

Technical Field

The present disclosure is directed to alloys, particularly to an antimicrobial alloy of titanium, niobium, and silver, and a method of preparation thereof.

Description of Related Art

The "background" description provided herein is to present the context of the disclosure generally. Work of the presently named inventors, to the extent it is described in this background section, as well as aspects of the description that may not otherwise qualify as prior art at the time of filing, are neither expressly nor impliedly admitted as prior art against the present invention.

Metals, and alloys such as stainless steel, titanium (Ti), and alloys, and cobalt (Co) alloys have been widely used clinically, such as dental implants, hip and knee replacements, bone plates, and screws due to their high strength, wear resistance, good corrosion resistance, high fatigue properties, and good biocompatibility. Yet implant-related infection or inflammation remains one of the leading causes of implantation failure. The probability of infection after implantation depends on the severity of the fracture.

Antibacterial metals and alloys have been described. Antibacterial properties of Copper (Cu) and silver (Ag) containing antibacterial metal alloys, such as antibacterial stainless steel, antibacterial Ti, antibacterial magnesium (Mg) and alloys, and antibacterial Co alloy have been described.

Ti and its alloys have emerged in the biomedical industry due to their superior tissue compatibility, corrosion resistance, and mechanical properties. Since the late 1970s, for instance, the usage of Ti-6aluminium (Al)-4vanadium (V) (Ti64) alloy for total-joint prosthesis has expanded dramatically due to its Young's modulus (about 110 gigapascal (GPa)). However, the vanadium in the alloy is potentially hazardous to human health-thereby restricting its use in implants and prostheses.

Traditionally, β or near β-type Ti alloys with a low Young's modulus and high corrosion resistance, such as Ti-niobium (Nb)-zirconium (Zr), Ti-24Nb-38Zr-2molybdenum (Mo), Ti-14Manganese (Mn)—Zr, Ti—Mo—Nb—Zr, and Ti-24Nb-4Zr-8Tin (Sn) have been developed. However, none of the aforementioned alloys address post-transplantation infection issues. The antibacterial properties of coatings containing $TiO_2$ has been described. Antibacterial properties of copper or silver containing titanium alloys have also been described. Studies also show that adding silver or copper to Ti-based alloys does not affect their biocompatibility and biocorrosion.

Although numerous implants have been developed in the past, there still exists a need to develop a bioimplant with reduced elastic modulus, enhanced corrosion resistance, and antibacterial properties.

SUMMARY

An antimicrobial alloy comprising titanium (Ti), niobium (Nb), and silver (Ag). Further, the antimicrobial alloy comprises between 5 and 30 atomic percent (at. %) Nb, up to 3 atomic percent Ag, between 67 and 94.9 atomic percent titanium based on the total number of Ti, Nb, and Ag atoms, and the alloy does not comprise zirconium; wherein the antimicrobial alloy has at least 51 percent beta-titanium crystal structure and an elasticity modulus ranging from 60 to 85 GPa as measured by micro indentation.

In some embodiments, the antimicrobial alloy has a bulk densification percentage, given by the following expression;

$$(\rho_{ex} \text{ of uniaxially pressed powder mixture})/(\rho_{ex} \text{ of sintered alloy})\times 100,$$

ranging from 80.0 to 95.0%, wherein $$\rho_{ex} = (a/(a-b)) * (\rho_L - \rho_a) + \rho_a$$

wherein $\rho_{ex}$ is the measured density of the specimen as measured by a high precision electronic densimeter, 'a' and 'b' are the weight of the specimen in air and water, respectively, '$\rho_L$' and '$\rho_a$' are the density of water and air, respectively.

In some embodiments, the bulk densification percentage ranges from 89.3 to 89.7% according to the same equation.

In some embodiments, the bulk densification percentage is around 86.2% according to the same equation.

In some embodiments, the antimicrobial alloy has a microhardness ranging from 2.692 to 2.742 GPa when measured according to ASTM E384

In some embodiments, the elasticity modulus is around 80 GPa as measured according to micro indentation.

In some embodiments, the antimicrobial alloy has a corrosion potential voltage ranging from −0.130 and −0.150 volts (V) measured using electrochemical impedance spectroscopy in at least one of the group consisting of artificial saliva and simulated body.

In some embodiments, the corrosion potential voltage is around −0.149 V measured using electrochemical impedance spectroscopy in at least one of the group consisting of artificial saliva and simulated body.

In some embodiments, the antimicrobial alloy inhibits gram-positive bacteria growth by 85 percent as measured by agar diffusion according to the equation $$\text{Inhibition efficiency rates (\%)} = (N0-N)/N0\times 100$$

wherein N0 and N represent the average number of CFUs in control and TNA alloy samples, respectively kills gram-positive (G+ve) bacteria.

In some embodiments, the antimicrobial alloy inhibits gram-negative bacteria growth by 88 percent as measured by agar diffusion according to the equation $$\text{Inhibition efficiency rates } (\%) = (N0-N)/N0 \times 100$$

wherein N0 and N represent the average number of CFUs in control and TNA alloy samples, respectively.

A process for manufacturing the antimicrobial alloy is also described. The process includes placing Ti, Nb, and Ag metal powders in a mixing apparatus under Argon (Ar) atmosphere and mixing to produce a powder_mixture. The quantities of the Ti, Nb, and Ag metal powders in the powder mixture result in an alloy including 5 to 30 atomic percent Nb and up to 3 atomic percent Ag, 67 to 94.9 atomic percent Ti when the atomic percent is based on the total number of Ti, Nb, and Ag atoms, and the powder mixture does not include Zr. Further, the process includes milling the powder mixture to a desired particle size. Further, the process includes pressing the powder mixture uniaxially, and further sintering the powder mixture at a temperature greater than about 1100 degrees centigrade (° C.) followed by an isothermal annealing at the temperature greater than 1100° C.

In some embodiments, the mixture is sintered at about 1300° C.

In some embodiments, the isothermal annealing time is 2 hours.

In some embodiments, the temperature of the powder mixture is raised to greater than about 1100° C. at a rate of 10° C. per minute.

In some embodiments, the powder mixture is uniaxially pressed at 550 megapascal (MPa).

In some embodiments, the antimicrobial alloy is a bioimplant.

The foregoing general description of the illustrative present disclosure and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
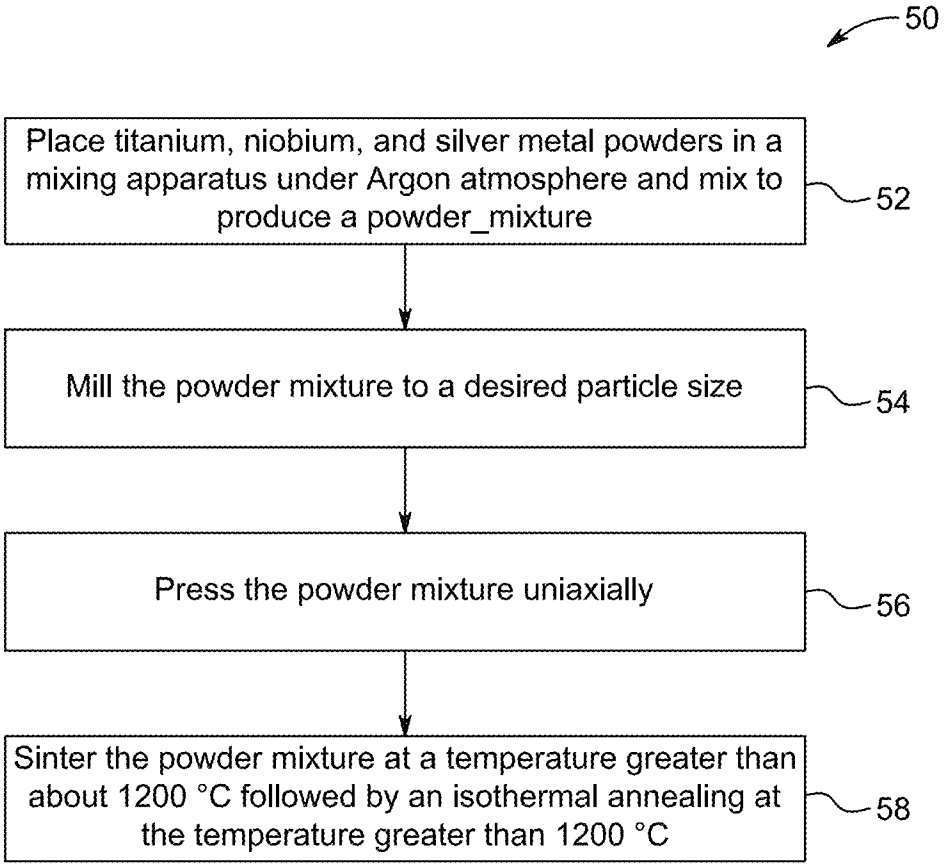
FIG. 1 is a schematic flow diagram of a process for manufacturing an antimicrobial titanium (Ti)-nobium (Nb)-silver (Ag) (TNA) alloy, according to certain embodiments.

In the drawings, reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

As used herein, the term "antimicrobial" refers to an agent that kills microorganisms or stops their growth.

As used herein, the term "alloy" refers to a metal made by combining two or more metallic elements.

As used herein, the term "elasticity" refers to the ability of a deformed material body to return to its original shape and size when the forces causing the deformation are removed.

As used herein, the term "corrosion" refers to a natural process that converts a refined metal into a more chemically stable oxide.

As used herein, the term "isothermal" refers to a type of thermodynamic process in which the temperature of a system remains constant.

As used herein, the term "annealing" refers to a heat treatment process that changes the physical and sometimes also the chemical properties of a material to increase ductility and reduce the hardness to make it more workable.

As used herein, the term, "isothermal annealing" is a heat treatment process similar to complete annealing with similar output, including creating pieces with reduced residual stress, improved machinability, and homogenized grain structures.

As used herein, the term "sintering" refers to a process of compacting and forming a solid mass of material by pressure or heat without melting it to the point of complete liquefaction.

Process for producing an antimicrobial TNA alloy.

FIG. 1 is a schematic flow diagram of a process for manufacturing an antimicrobial titanium (Ti)-nobium (Nb)-silver (Ag) (TNA) alloy, according to certain embodiments.

At step 52, the method 50 includes placing titanium, niobium, and silver metal powders in a mixing apparatus under argon (Ar) atmosphere and mixing to produce a powder mixture. The respective metal powders of titanium, niobium, and silver are taken in such a proportion and mixed together to give the powder mixture. In an embodiment, the weight ratio of Nb to Ag metal powder in the powder mixture is in a range of 1:1 to 20:1, preferably 5:1 to 15:1, and more preferably about 10:1. In some embodiments, the weight ration of Nb to Ti metal powder in the powder mixture is in a range of 1:5 to 5:1, preferably 1:1 to 1:3, and more preferably about 1:2 to 1:2.5.

Optionally, lubricants are included; example lubricants include, but are not limited to, stearic acid, stearin, metallic stearates or other organic compound of a waxy nature may be introduced into the mixing apparatus to reduce friction (and therefore even out density variations). The step is preferably carried out in an inert atmosphere to prevent metal oxidation.

Optionally, the individual metal powders of titanium, niobium, and silver can be mixed in a nitrogen atmosphere.

In some embodiments, the particle size of the powder mixture was more than 20 μm.

At step 54, the method 50 includes milling the powder mixture to a desired particle size. Ball, hammer, vibratory, attrition, and tumbler mills may be used to carry out this step. In some embodiments, the powder blends were mechanically alloyed at 250 revolutions per minute (rpm) for up to 60 hours in an inert argon atmosphere.

At step 56, the method 50 includes pressing the powder mixture uniaxially. In some embodiments, the powder mixture is uniaxially pressed at a pressure of 400-700 Mpa, preferably about 450-600 MPa, and more preferably to about 550 MPa. In some embodiments, cold compacting was carried out using a uniaxial hydraulic press, but other similar machinery may be employed. Tool steel die with a bore diameter of 20 mm was employed, and the samples were compacted at a pressure of 550 megapascals (MPa).

At step 58, the method 50 includes sintering the powder mixture at a temperature greater than about 1100 degrees centigrade (° C.) followed by an isothermal annealing at the temperature greater than 1100° C. In some embodiments, the sintering may be performed by placing the mixed powders into a furnace such as a tube furnace, for example, in a ceramic crucible (e.g., an alumina crucible) or other forms of containment, and heating to the temperatures described above. The furnace is preferably equipped with a temperature control system, which may provide a heating rate of up to 50° C./min, or preferably up to 40° C./min, or more preferably up to 30° C./min, further preferably up to 20° C./min, and most preferably up to 10° C./min. In preferred embodiments, the mixed powders are heated with a heating rate in the range of 1 to 15° C./min, preferably 3 to 10° C./min, to an elevated temperature (e.g., above 1100° C., preferably above 1200° C., more preferably to about 1300° C.) for 1 to 5 hours, preferably 1 to 3 hours, more preferably 2 hours. The method further involves annealing the sintered alloy to an isothermal annealing temperature of 700-1300° C., preferably 800-1200° C., where the sintered alloy is subjected to isothermal annealing for 1-10 h, preferably about 2-5 hours, more preferably for about 2-3 hours. The annealed alloy may be further process/subjected to steps like cooling, hardening/tempering operation to obtain the TNA alloy.

Figure 2:
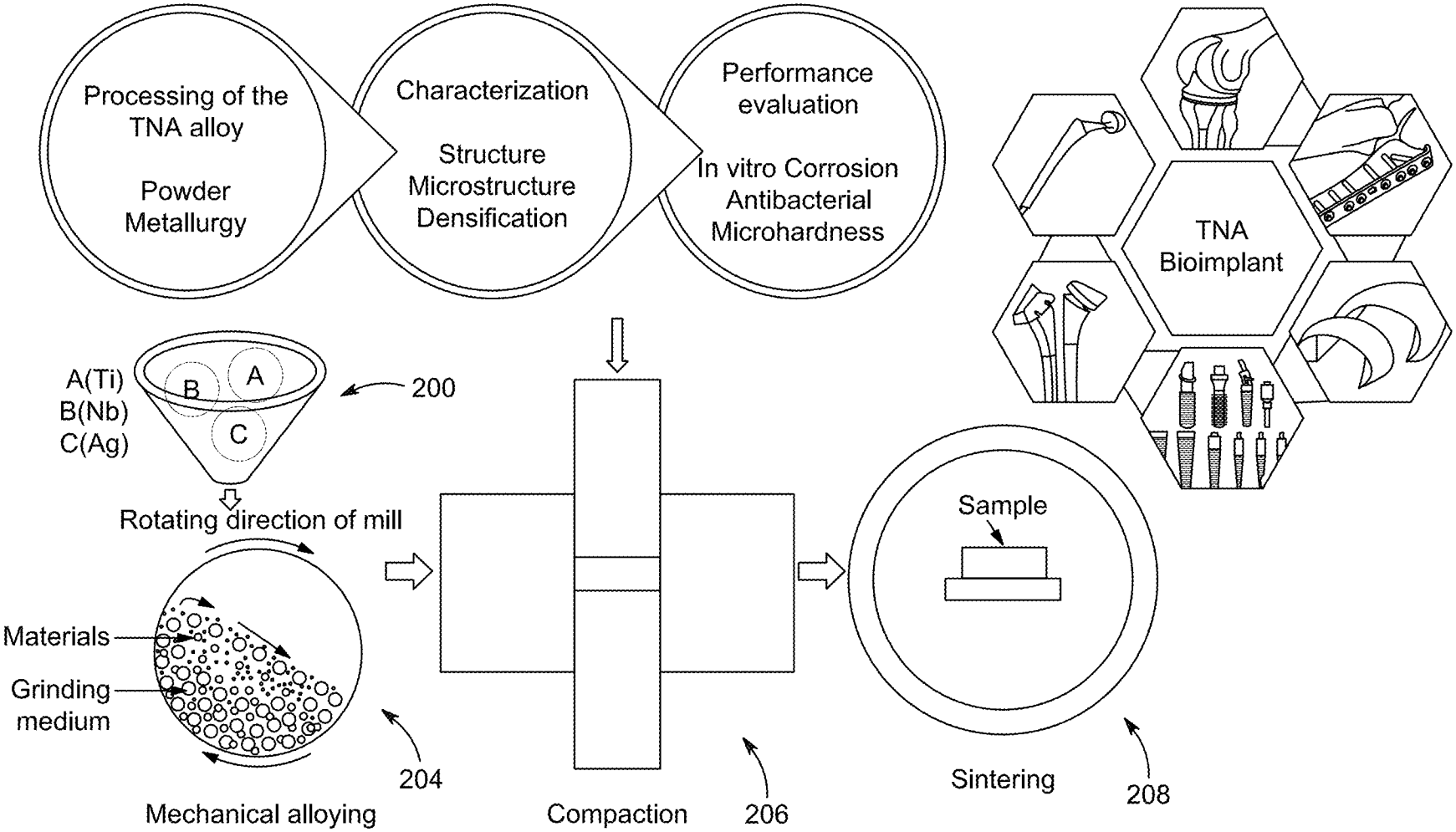
FIG. 2 shows a schematic diagram for processing the TNA alloy, according to certain embodiments.

FIG. 2 shows a schematic diagram for processing the TNA alloy, according to certain embodiments. The blended TNA alloy powders were loaded in WC vials with WC balls, 10 millimeters (mm) diameter, in a ball-to-powder ratio of 10:1 in the mechanically alloying machine (Planetary Micro Mill PULVERISETTE 7 premium line) under an argon (Ar) atmosphere to avoid oxidation 202. Then the powder blends were mechanically alloyed at 250 revolutions per minute (rpm) for up to 60 hours in an inert Ar atmosphere 204. Cold compacting of the TNA alloy powders milled for up to 60 hours was carried out using a uniaxial hydraulic press. Tool steel die with a bore diameter of 20 mm was employed, and the samples were compacted at a pressure of 550 megapascals (MPa) 206. The compacted powder was then sintered in a tube furnace (GSL-1700X, MTI) at 1300 degrees centigrade (° C.) for 2 hours in a high-purity argon environment. The samples were heated at a rate of 10° C./min and cooled to room temperature in the furnace 208 to obtain the alloy.

After MA, nanocrystalline β-Ti (body-centered cubic (BCC)) and α-Ti (hexagonal closed packing (HCP)) solid solutions with crystallite sizes of 7.44 nanometers (nm) and 3.47 nm, respectively formed. The sintered TNA alloy exhibited bulk densification percentages of 97%, with a microstructure comprising β-Ti, α-Ti, and a minor quantity of ultrafine $Ti_2Ag$ phase. The microhardness result showed that Ti-30Nb-3Ag possesses a Vickers hardness (HV) of 491.5. Ti-30Nb-3Ag alloy inhibited antibacterial growth by 85.75% and 88.81% relative to commercial alloy (Ti6Al4V) alloy and control (CPTi), respectively. In vitro corrosion-resistant results revealed that the Ti-30Nb-3Ag alloy exhibited a widespread passive area in the investigated anodic regions and presented higher impedance values compared to commercial alloys.

Antimicrobial TNA Alloy

The TNA alloy was designed from biocompatible and non-toxic elements using a combination of molybdenum equivalency [Mo]eq, the d-electron alloy design method, and electron-to-atom (e/a) ratio methodologies. [Mo]eq was designed to denote the contribution of each element to the phase stability of Ti alloys. The average [Mo]eq value for the designed TNA alloy was 14.37, calculated according to previously proposed models. [Mo]eq value more than or equal to 10.0 is required for β stabilizer content. Bond Order (BO) and average metal d-orbital energy levels (MD) were calculated, and the values for the designed alloy are located in the β region in the BO-MD map. The computed (e/a) for the TNA alloy was 4.21which is around the stability limit of β-phase Ti alloy.

Embodiments of the present disclosure are directed to an antimicrobial titanium (Ti)-nobium (Nb)-silver (Ag) (TNA) alloy and a method of preparation thereof. The TNA alloy is preferably a Ti-30Nb-3Ag alloy (30 at. % of niobium, 3 at. % of silver, and 67 at. % of titanium) with enhanced corrosion resistance and antibacterial properties that is formed by mechanical alloying (MA) followed by compaction and sintering.

The alloy includes between 5 and 30 atomic percent niobium, preferably 10-30 atomic percent, 15-25 at. % or about 20 at. %, and more preferably about 30 at. % of niobium based on the total atomic percentage of the alloy. The alloy further comprises 1-10 at. %, preferably 2-5 at. %, and more preferably about 3 at. % of Ag based on the total atomic percentage in the alloy. The alloy further comprises about 65-70 at. % of Ti, preferably about 65-69 at. %, and more preferably about 67 at. % based on the total atomic percentage in the alloy. The alloy preferably consists of atoms of Ti, Nb and Ag.

According to an aspect of the present disclosure, the titanium of the antimicrobial alloy may exist in two crystalline states—hexagonal close-packed (alpha), and body-centered cubic (beta) state. In a preferred embodiment, titanium in the alloy exists in beta state. The crystallites of the alpha and beta state may range from 1-10 nanometers (nm), preferably 2-9 nm, and more preferably 3-8 nm.

The antibacterial allow has an elastic modulus between 60 to 85 GPa, preferably 65 to 82 GPa, and more preferably about 80 GPa as measured by micro indentation. The TNA alloy has a porosity ranging from 80 to 95%, preferably 85 to 90%, and more preferably around 86.2%. The TNA alloy has a microhardness ranging from 2.692 to 2.742 GPa.

Figure 3:
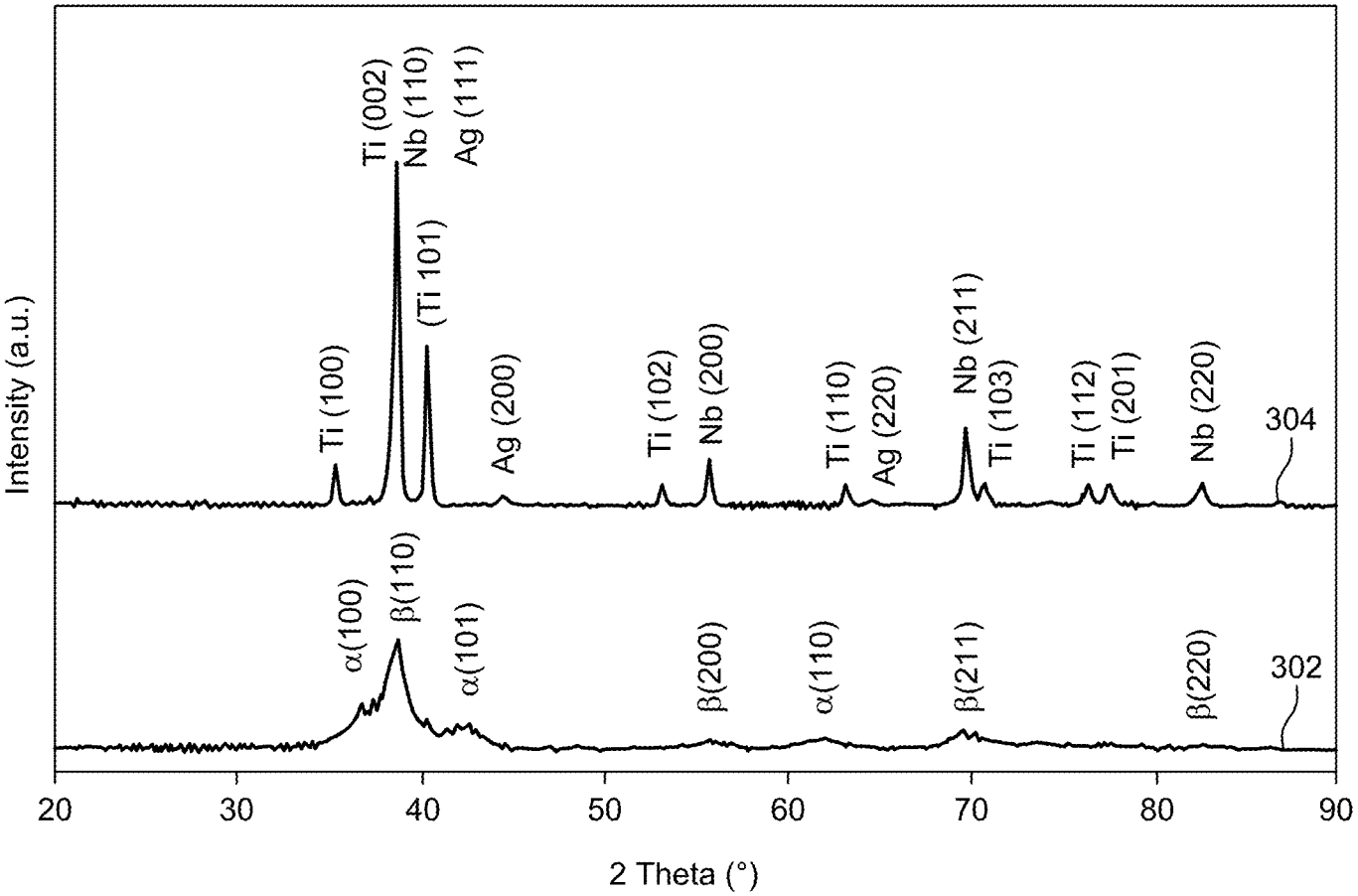
FIG. 3 shows an X-ray diffraction (XRD) of TNA powders as a mixed powder (302), and TNA powder mechanically alloyed for 60 hours (304), according to certain embodiments.
Figure 4A:
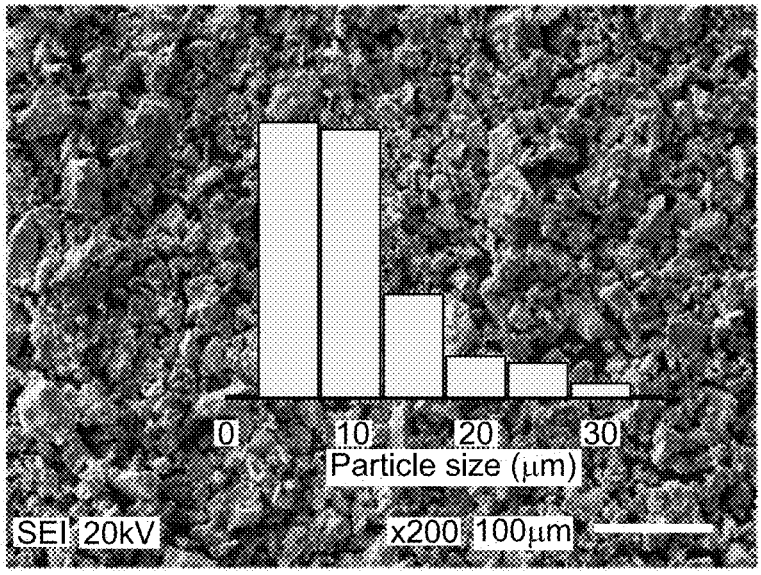
FIG. 4A shows a scanning electron microscope (SEM) image of the TNA powders, as a blended alloy mixture, at 200× magnification with 100 μm particle size, according to certain embodiments.
Figure 4B:
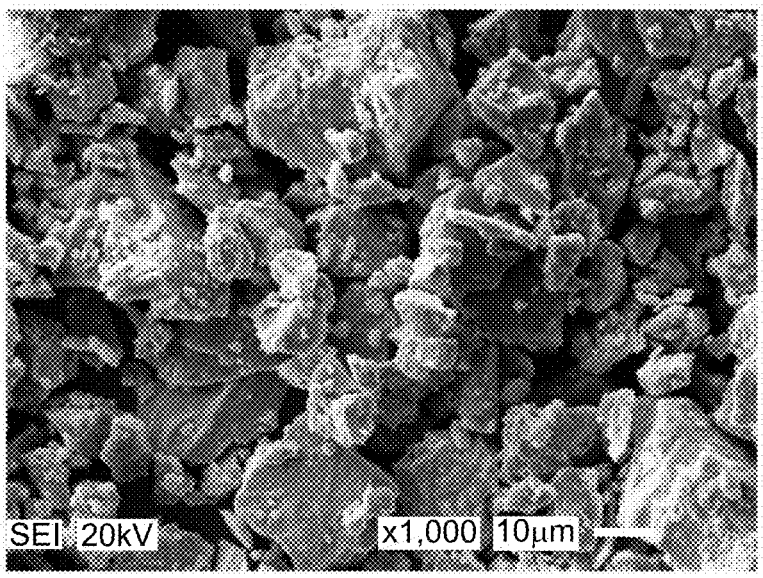
FIG. 4B shows the SEM image of the TNA powders, as a blended alloy mixture, at 1000× magnification with 10 μm particle size, according to certain embodiments.
Figure 4C:
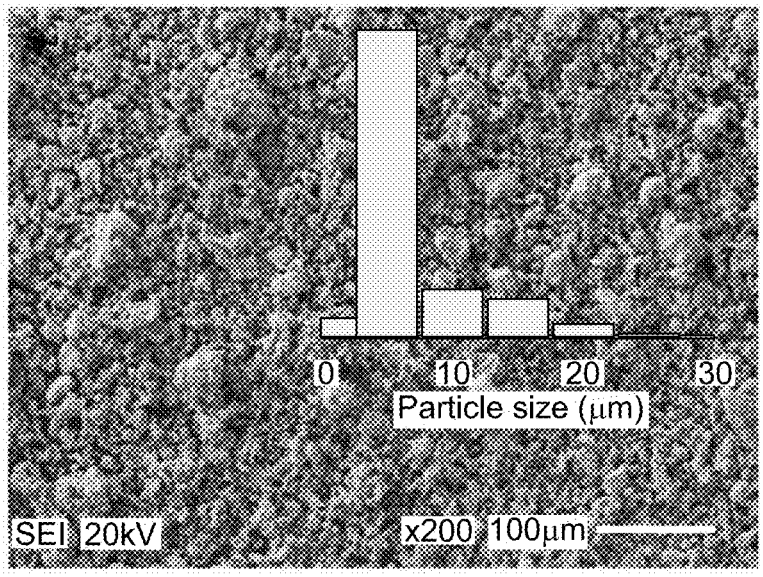
FIG. 4C shows the SEM image of the TNA powder mechanically alloyed for 60 hours at 200× magnification with 100 μm particle size, according to certain embodiments.
Figure 4D:
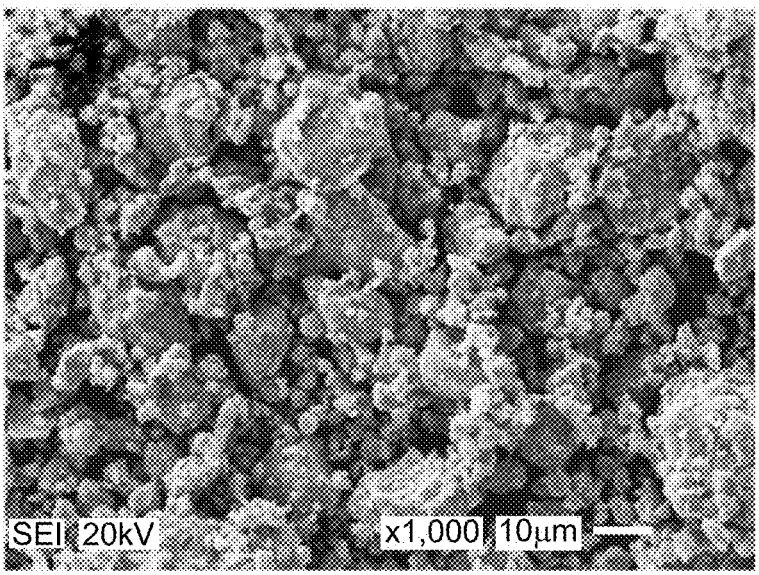
FIG. 4D shows the SEM image of the TNA powder mechanically alloyed for 60 hours at 1000× magnification with 10 μm particle size, according to certain embodiments.

FIG. 3 depicts the XRD patterns of the TNA alloy powders before 302 and after ball milling 304. All the peaks are present in the as-received blended powders 302. However, after the mechanical alloying (MA), the intensity of the diffraction peaks dropped, and the diffraction pattern changed 304. The pattern demonstrates the disappearance of raw powder peaks and the formation of β-Ti and α-Ti solid solutions as Nb and Ag dissolved into Ti to form a solid solution. After MA, the peaks of the blended powder became broader and eventually disappeared. According to the Scherrer equation, β-Ti, and α-Ti solid solutions of TNA alloy after 60 hrs of machine alloying preferably have crystallite sizes of 7.44 nanometers (nm) and 3.47 nm, respectively, compared to a crystallite size of as received Ti, Nb, and Ag estimated as 50.2, 46.8 and 23.5 nm respectively. Other embodiments have crystallite sized of 2-15 nm and 2-10 nm respectively, more preferably 5-10 nm and 3-5 nm respectively.

FIG. 4 shows the SEM micrographs of the TNA alloy powder blend before and after MA. The raw initial powder mixture before MA contains diverse irregular and elongated shapes, as can be observed in FIG. 4A and FIG. 4B. The SEM images of the TNA alloy powder's morphology after 60 hrs of MA are depicted in FIG. 4C and FIG. 4D, respectively. FIGS. 4A-4D inset also shows the particle size distribution of powders before and after MA. Compared to the as-received powders, the average particle size was smaller in the MA condition and that the shape of the powder particles was spherical and more uniform in the MA condition. The average grain size of powders in the initial powder mixing was measured as 8.2 μm which decreased to 4.6 μm after MA. Moreover, the grain size distribution in FIGS. 4A and 4C inset, the number of large grains with a size of more than 20 μm were minimal after MA and smaller particles with a size of less than 5 μm were predominant. Due to the aggregation of smaller particles and the cold welding, several big grains have also emerged because during ball collisions, powder particles were extensively deformed, broken, and cold-welded together.

Figure 5A:
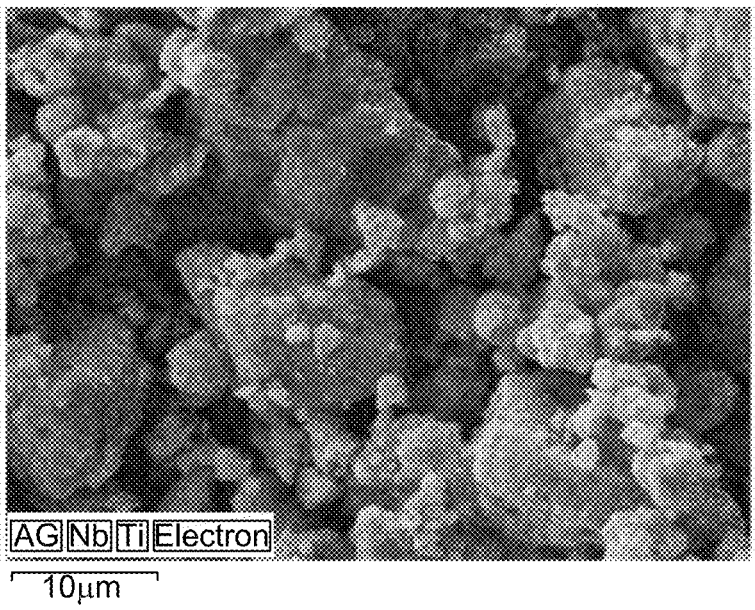
FIG. 5A shows an energy-dispersive X-ray spectroscopy (EDX) mapping for the TNA powder mechanically alloyed for 60 hours showing the distribution of Ti, Nb, and Ag elements, according to certain embodiments.
Figure 5B:
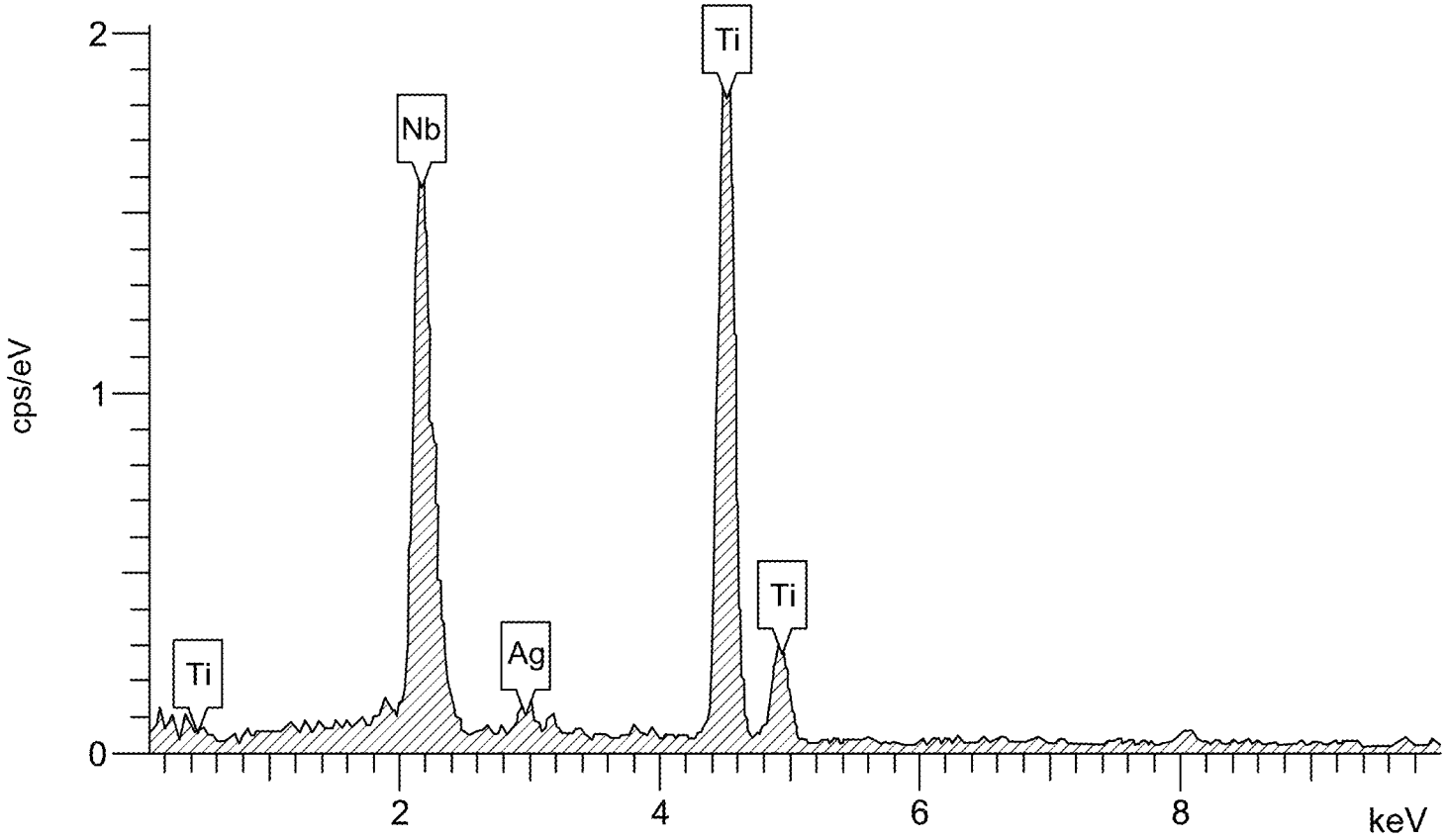
FIG. 5B shows the EDX spectrum for TNA powder mechanically alloyed for 60 hours showing the distribution of Ti, Nb, and Ag elements, according to certain embodiments.
Figure 5C:
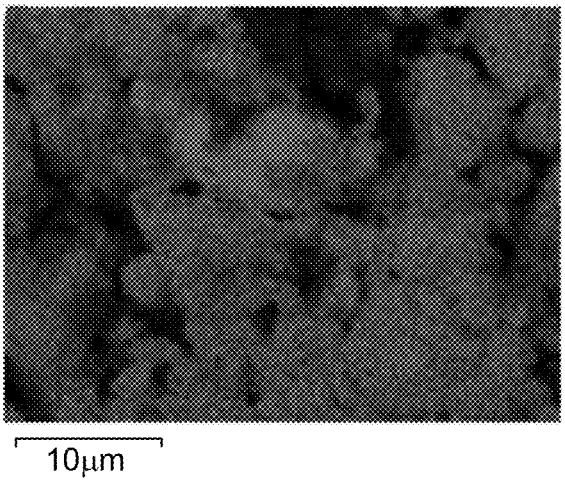
FIG. 5C shows the EDX mapping of the TNA powder mechanically alloyed for 60 hours showing Ti separately at 1000× magnification with 10 μm particle size, according to certain embodiments.
Figure 5D:
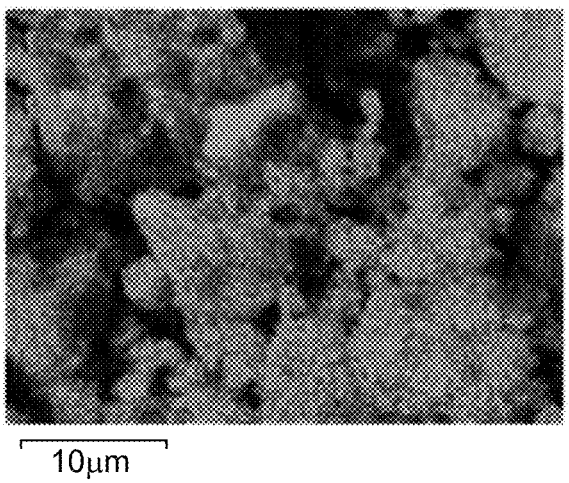
FIG. 5D shows the EDX mapping of the TNA powder mechanically alloyed for 60 hours showing Nb separately at 1000× magnification with 10 μm particle size, according to certain embodiments.
Figure 5E:
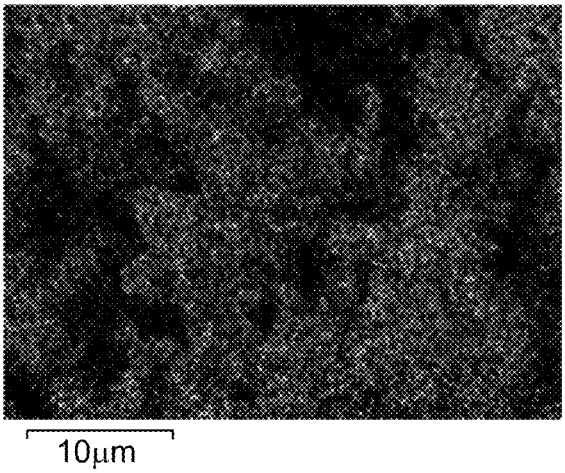
FIG. 5E shows the EDX mapping of the TNA powder mechanically alloyed for 60 hours showing Ag separately at 1000× magnification with 10 μm particle size, according to certain embodiments.

FIG. 5A-E depict the EDX elemental mapping performed to determine the distribution of the powder's constituent elements. FIG. 5A depicts the relatively uniform distribution of Ti, Nb, and Ag throughout the whole region, confirming the successful alloying of the powders after milling through EDX mapping. FIG. 5B depicts the relatively uniform distribution of Ti, Nb, and Ag throughout the whole region, confirming the successful alloying of the powders after milling through EDX spectrum. FIGS. 5C-5E show EDX mappings of Ti, Nb and Ag respectively at 1000× magnification. Compared to the as-received powders, the average particle size was smaller in the MA condition and that the shape of the powder particles was spherical and more uniform in the MA condition. Due to the aggregation of smaller particles and the cold welding, several big particles had also emerged.

Figure 6:
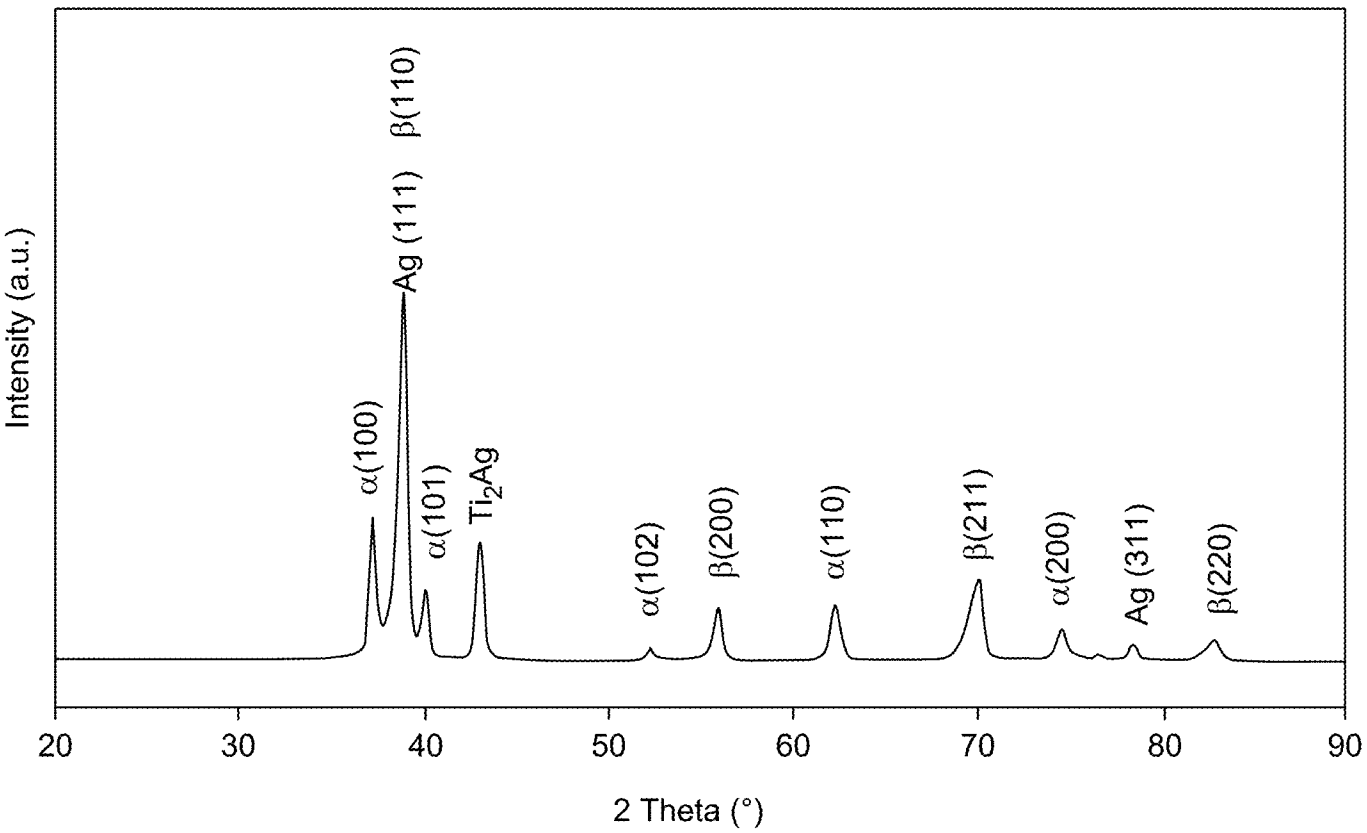
FIG. 6 shows the XRD of the TNA alloy which was mechanically alloyed for 60 hours and sintered at 1300 degrees centigrade (° C.), according to certain embodiments.

FIG. 6 depicts the XRD of sintered TNA alloy. The XRD of sintered specimens revealed the existence of the β-Ti (body-centered cubic (BCC)) phase, α-Ti (hexagonal closed packing (HCP)) phase peaks, and $Ti_2Ag$ phases with lower intensities. No oxide diffraction peaks were found. Due to the difference in diffusion coefficients, Nb diffuses faster into Ti. The larger intensity of the β-Ti phase peaks than the α-Ti phase peaks indicates that the β phase is more prevalent than the α phase. The weak intensity of the $Ti_2Ag$ peaks suggests that it was present only in trace amounts. The crystallite size of the β-Ti (BCC) phase, α-Ti (HCP), and $Ti_2Ag$ phase are 13 nm, 25.8 nm, and 35.1 nm, respectively. In other embodiments the crystallite sizes are between 1-20 nm, 5-30 nm, and 10-40 nm, respectively; preferably 5-15 nm, 15-28 nm, and 20-38 nm; more preferably 10-15 nm, 24-27 nm, and 30-35 nm, respectively.

Figure 7A:
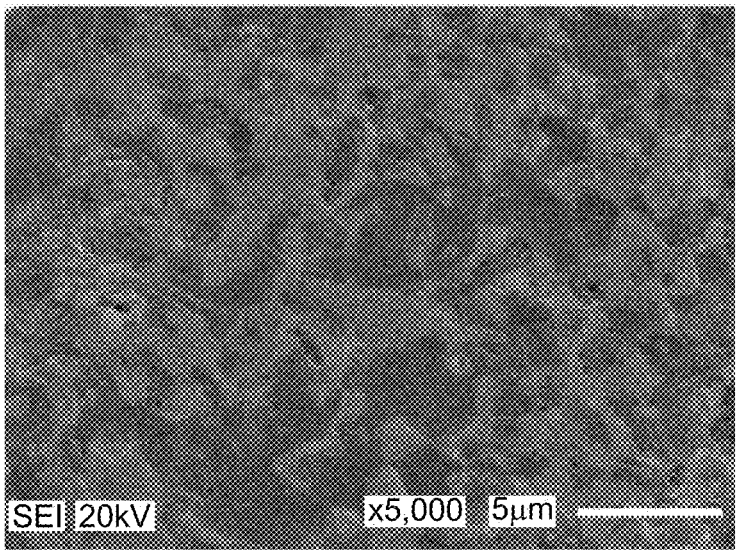
FIG. 7A shows a secondary electron (SE) image in SEM of the TNA alloy at 5000× magnification with 5 μm particle size, according to certain embodiments.
Figure 7B:
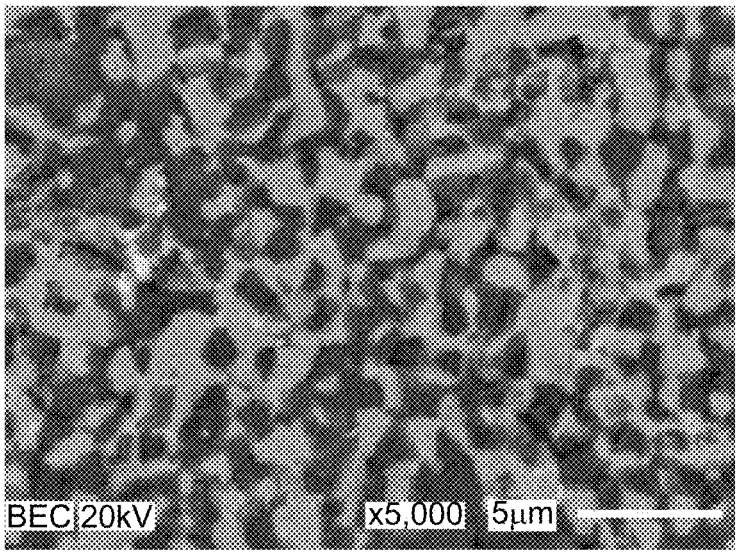
FIG. 7B shows a backscattered electron (BE) image in SEM of the TNA alloy at 5000× magnification with 5 μm particle size, according to certain embodiments.
Figure 7C:
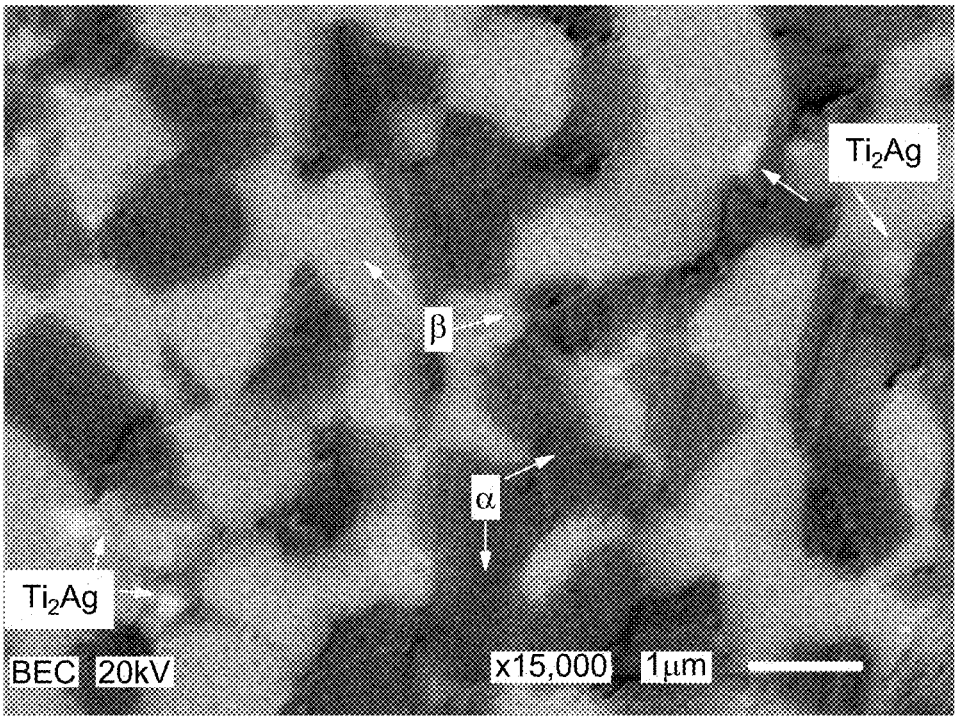
FIG. 7C is the BE image depicting different phases of TNA alloy at a high magnification, according to certain embodiments.
Figure 8A:
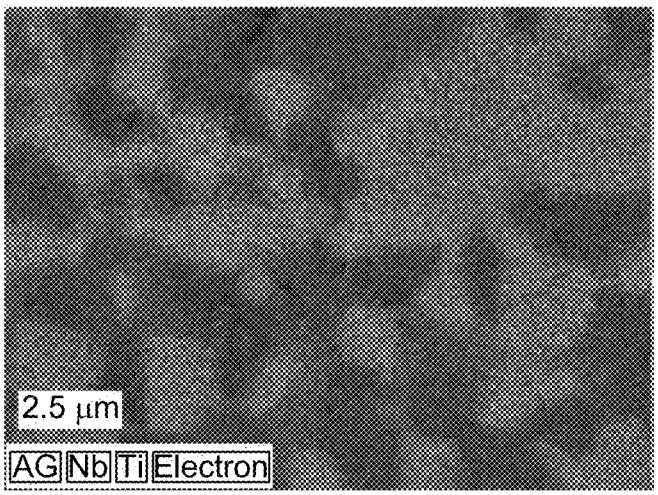
FIG. 8A shows the EDX Mapping of the TNA alloy showing the distribution of Ti, Nb, and Ag elements, according to certain embodiments.
Figure 8B:
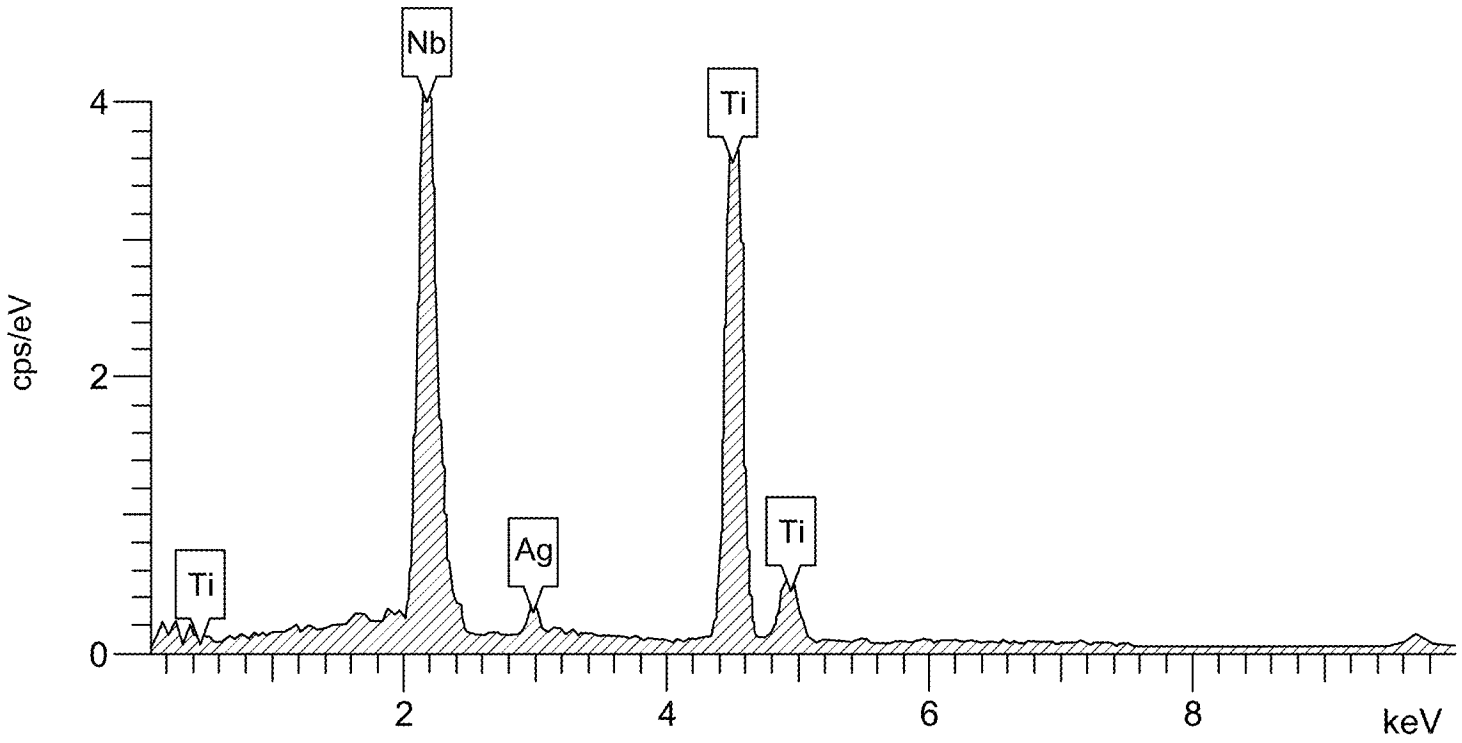
FIG. 8B shows the EDX spectrum of the TNA alloy showing the distribution of Ti, Nb, and Ag elements, according to certain embodiments.
Figure 8C:
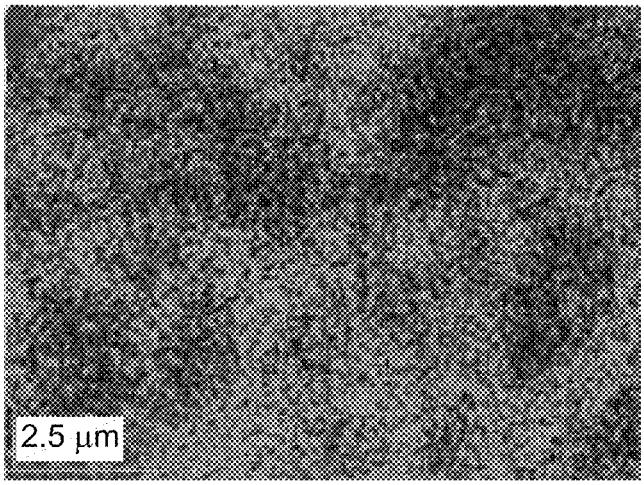
FIG. 8C shows the EDX mapping of the TNA alloy showing Ti separately with 2.5 μm particle size, according to certain embodiments.
Figure 8D:
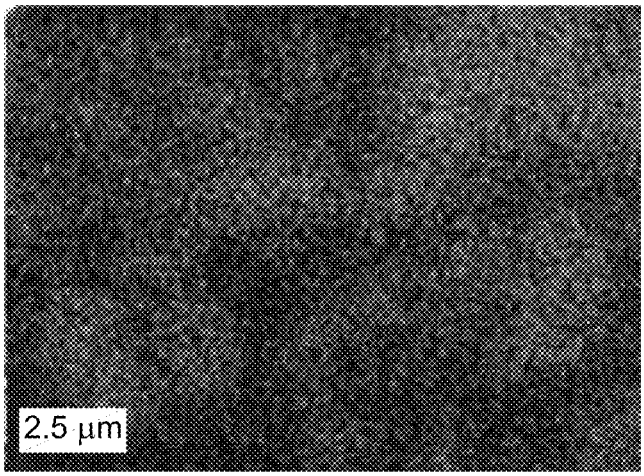
FIG. 8D shows the EDX mapping of the TNA alloy showing Nb separately with 2.5 μm particle size, according to certain embodiments.
Figure 8E:
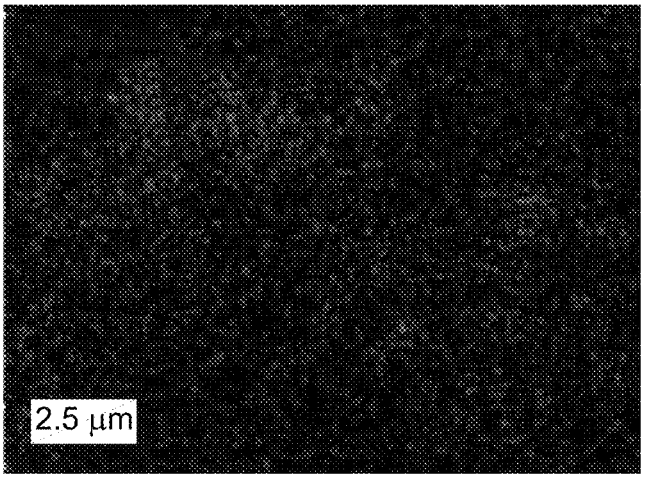
FIG. 8E shows the EDX mapping of the TNA alloy showing Ag separately at 1000× magnification with 10 μm particle size, according to certain embodiments.

FIG. 7 and FIG. 8 depict SEM micrographs of TNA alloy following sintering. From the low-magnification photograph, it was evident that the alloys were dense and poreless (FIGS. 7A-7B). FIG. 7A shows the SE image of the different phases of TNA alloy. The grey-scale image of the microstructure revealed three distinct phases: a black phase, a grey phase, and a white phase that was scattered along the phase boundaries of the grey phase (FIG. 7B). FIG. 7B shows the grey-scale image of the different phases of TNA alloy. FIG. 7C shows the high magnification grey-scale image showing the different phases of TNA alloy. Ti was concentrated in the dark phase (FIG. 8C); Nb was concentrated in the grey phase (FIG. 8D); and Ag was concentrated in the white phase (FIG. 8E), as determined by EDX mapping (FIG. 8A). FIG. 8B shows the EDX spectrum of TNA alloy showing the distribution of Ti, Nb, and Ag elements. Based on the XRD pattern (FIG. 6). and the mapping results (FIG. 8A), it could be determined that the bright contrast corresponds to ultrafine $Ti_2Ag$ grains, that the region with dark contrast was an α phase, and that the region with grey contrast is β phase.

From the microstructure (through SEM image analysis), β and α phase constitutes approx. 53% and 46% proportion, respectively with ≈1% of $Ti_2Ag$ rich phase at the grain boundaries. The average grain size of the α and β phases are 1.1 μm and 1.4 μm respectively. According to the XRD analysis, the alloy comprises two phases: β-Ti (BCC) and α-Ti (HCP). The microstructure was comprised of fine, equiaxed α grains encased in a β matrix.

The XRD data of mechanically alloyed powder after ball milling indicates that Ti, Nb, and Ag formed a metastable β solid solution. During the cooling stage of the sintering, a portion of the high-metastable β transformed into α Ti, and the surplus Ag precipitated to create an ultrafine Ag phase/Ti2Ag phase. The solubility limit of Ag in Ti at the α-β transformation temperature was around 4.7%. The Ti—Ag phase diagram reveals that the solubility of Ag in β Ti was approximately 14% at 1000° C. and declines with decreasing temperature. The crystallite size of the β-Ti and α-Ti phases is determined to be 11.7 nm and 17.3 nm for the sample sintered, respectively, using the Scherrer equation. The nanocrystalline alloys have higher surface energy and a larger surface area than coarse grains, and hence they interact with cells more effectively, resulting in increased cell proliferation and adherence to the alloy.

Antibacterial Analysis

FIG. 9 shows the antibacterial properties of all samples were evaluated by using *Staphylococcus aureus* and *Escherichia coli*. After the incubation, a low zone of inhibition formed, and a slight inhibition efficiency rate in both G+ve and G−ve strains for CPTi (FIGS. 9A and 9D) and Ti64 (FIGS. 9B and 9E) control samples. The TNA alloy sample (FIGS. 9C and 9F) has significant antibacterial activity compared to other samples. The obvious zone of inhibition and antibacterial inhibition efficiency rate was determined to be 88.18% for *Staphylococcus aureus* and 80.0% for *Escherichia coli*, respectively % relative to Ti64 alloy. TNA alloy showed antibacterial inhibition efficiency of 85.75% and 88.81% relative to Ti64 alloy and CPTi as control %, respectively, indicating a robust inhibitory effect on G+ve and G−ve strains.

Figure 9A:
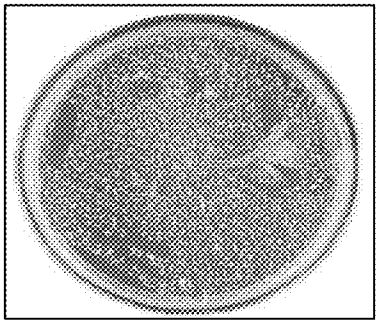
FIG. 9A shows a bacterial viable cell count on a commercially pure titanium (CPTi), according to certain embodiments.
Figure 9B:
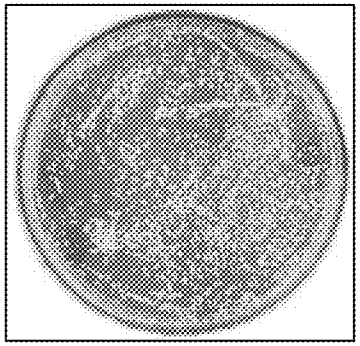
FIG. 9B shows a bacterial viable cell count on a Ti64 alloy, according to certain embodiments.
Figure 9C:
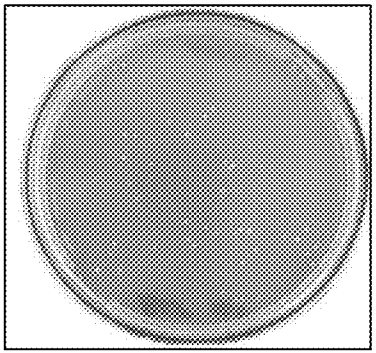
FIG. 9C shows a bacterial viable cell count on the TNA alloy, according to certain embodiments.
Figure 9D:
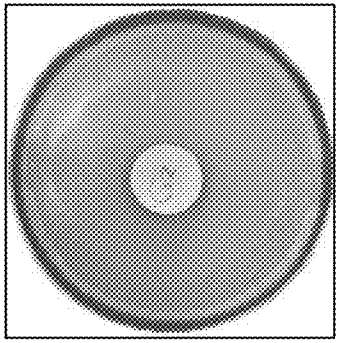
FIG. 9D shows related image of the CPTi of FIG. 9A, according to certain embodiments.
Figure 9E:
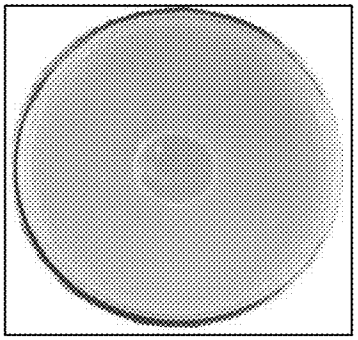
FIG. 9E shows related image of the Ti64 alloy, of FIG. 9B according to certain embodiments.
Figure 9F:
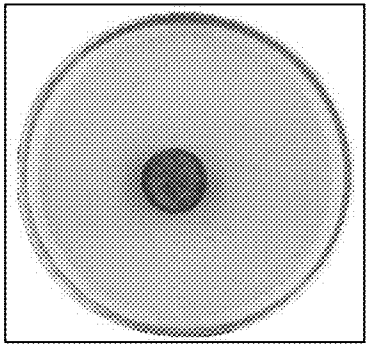
FIG. 9F shows related image of the TNA alloy of FIG. 9C, according to certain embodiments.
Figure 9G:
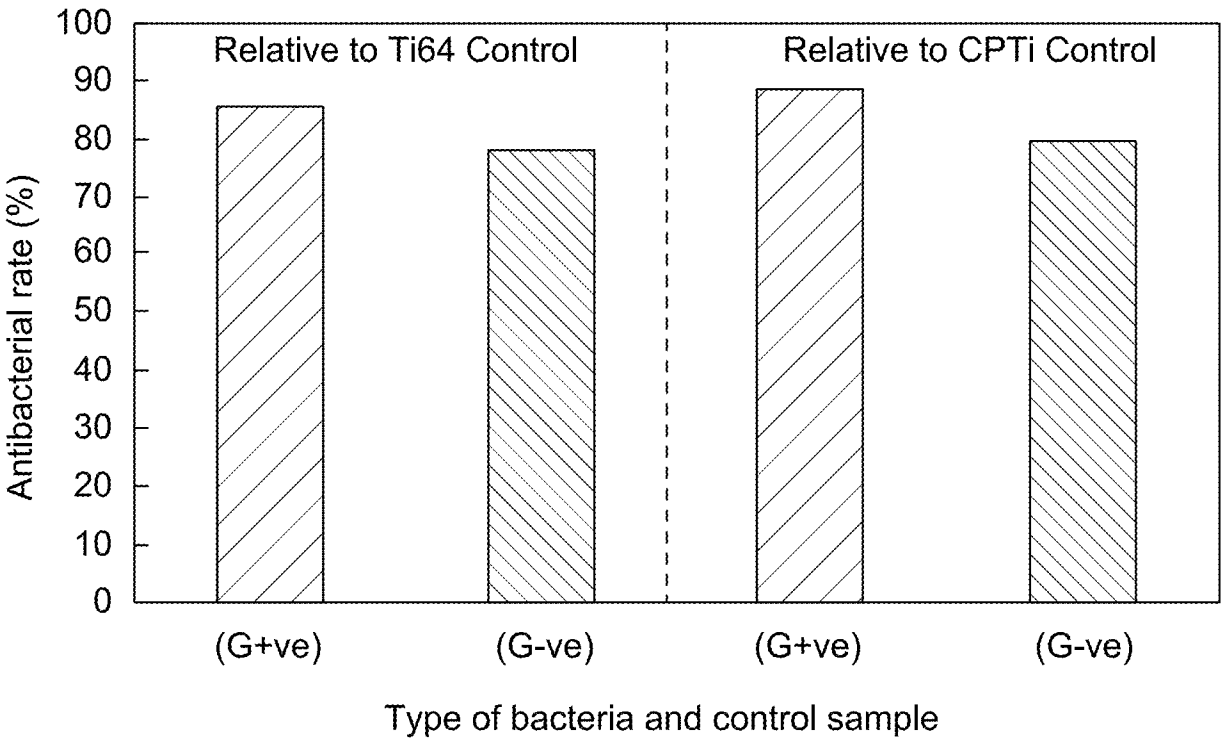
FIG. 9G shows calculated antibacterial rates for TNA alloy against gram-positive (G+ve) and gram-negative (G−ve) bacteria, relative to CPTi and Ti64 alloy (control), according to certain embodiments.

After incubation, the antibacterial capabilities of TNA alloy differed significantly from those of Ti64 and CPTi., Neither CPTI nor Ti64 developed a zone of inhibition in either gram-positive or gram-negative strains, as seen in FIG. 9A and FIG. 9C, respectively. TNA alloy showed antibacterial inhibitory efficacy of 85.75 and 88.81 percent relative to Ti64 alloy and CPTi as controls. FIGS. 9B and 9E illustrate the bacteria grown on the surface of Ti64 alloy and TNA alloy, as well as the antibacterial activity rates. Numerous bacterial colonies were found on Ti64, showing that it lacks antibacterial capabilities. A tiny number of colonies were seen on TNA alloy, as their number dropped.

The results indicated that the inclusion of Ag increased the TNA alloy's antibacterial properties. The precipitation of $Ti_2Ag$ during contact sterilization determined the antibacterial performance of Ti—Ag alloys. Ag ion has a significant impact on antibacterial performance, and Ti—Ag alloys' antibacterial performance is determined by Ag ion from $Ti_2Ag$.

The TNA alloy displays several unexpectedly advantageous effects. First, the TNA alloy shows surprising superior antibacterial growth inhibition compared to other titanium-silver alloys. Antibacterial growth inhibition for TiAg alloys typically occurs at higher Ag concentrations, usually between 4-5% when subjected to post-annealing surface treatments to roughen the surface and facilitate the release of silver ions. However, the TNA alloy of the present disclosure requires no such surface treatment to encourage silver ion release from the $Ti_2Ag$ precipitates. Second, the elasticity modulus is lower than other titanium-niobium alloys, making the TNA alloy a better match for bone. A closer elastic modulus match to the elastic modulus of bone lowers the risk of implant failure. Bone elastic moduli have been disclosed as ranging from 17.9-18.2 GPa in the longitudinal direction and 6.5-10.1 GPa in the transverse direction.

In Vitro Corrosion Studies

Figure 10A:
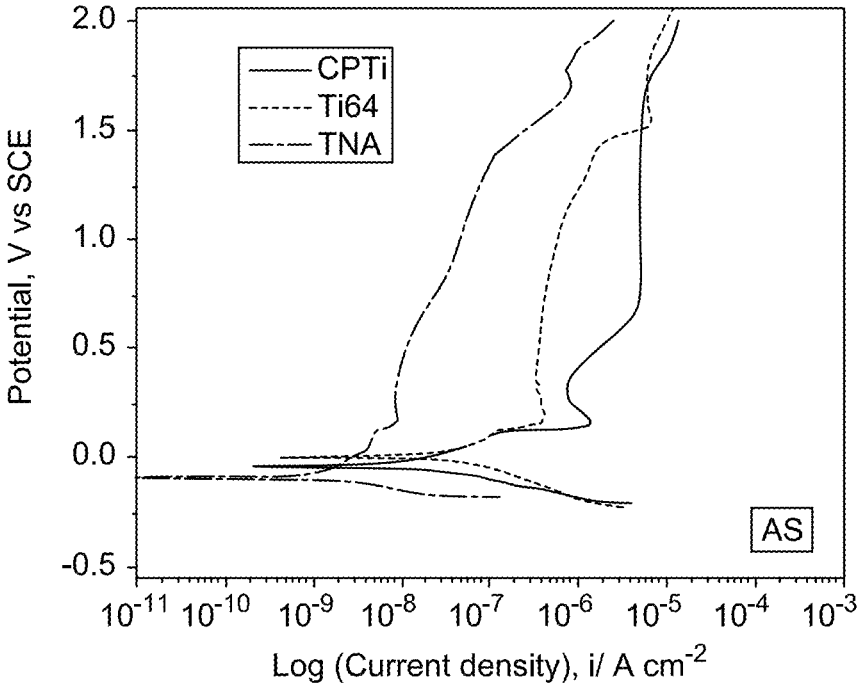
FIG. 10A shows a potentiodynamic polarization (PDP) of the TNA alloy compared to the CPTi and the Ti64 alloy, tested in an artificial saliva (AS), according to certain embodiments.
Figure 10B:
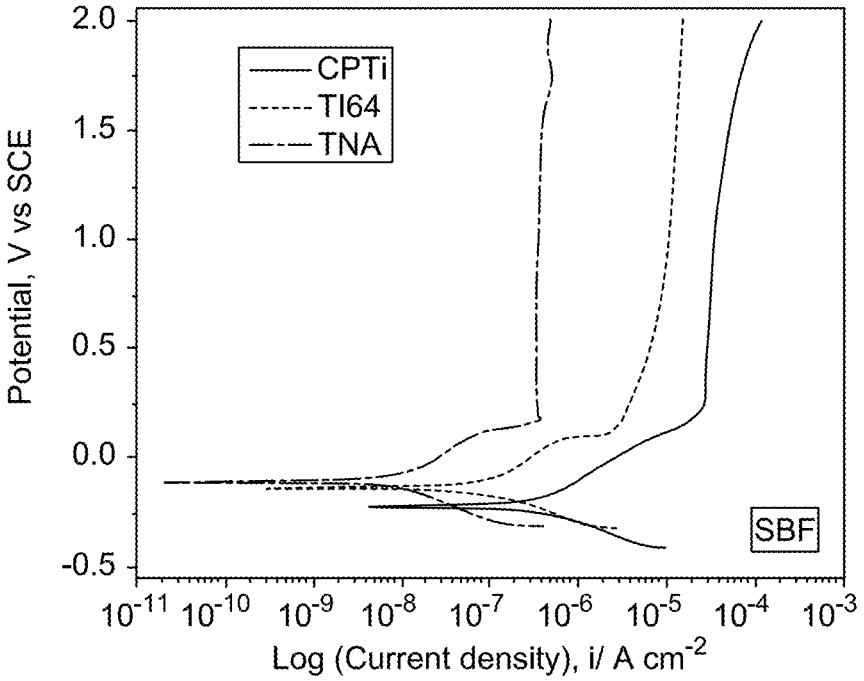
FIG. 10B shows PDP of the TNA alloy compared to the CPTi and the Ti64 alloy, tested in a simulated body fluid (SBF), according to certain embodiments.
Figure 11A:
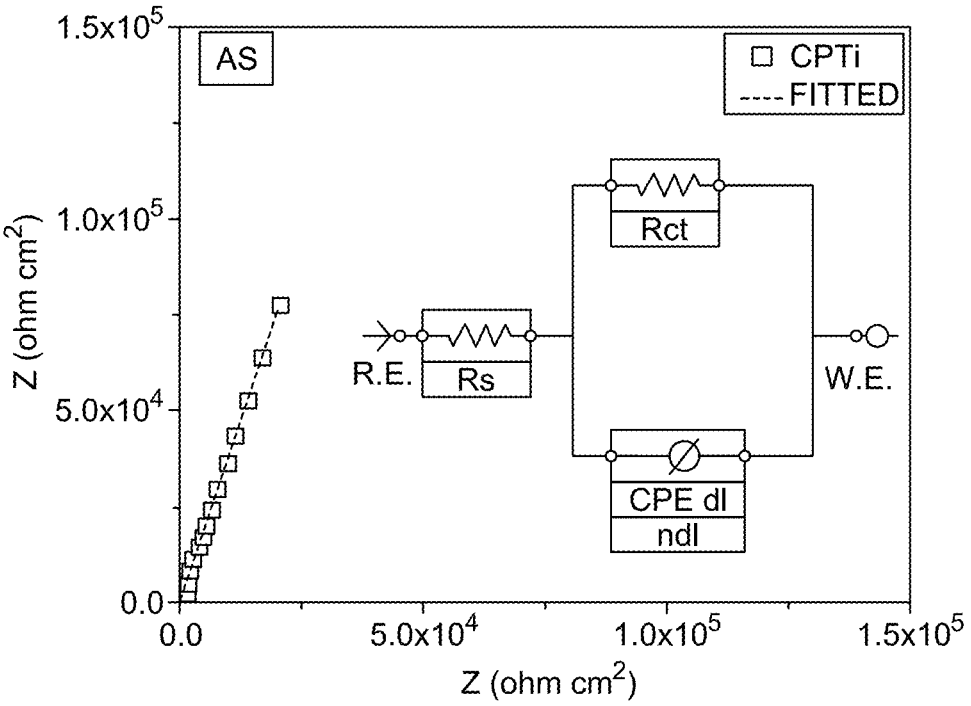
FIG. 11A shows a Nyquist plot of the CPTi tested in the AS medium, according to certain embodiments.
Figure 11B:
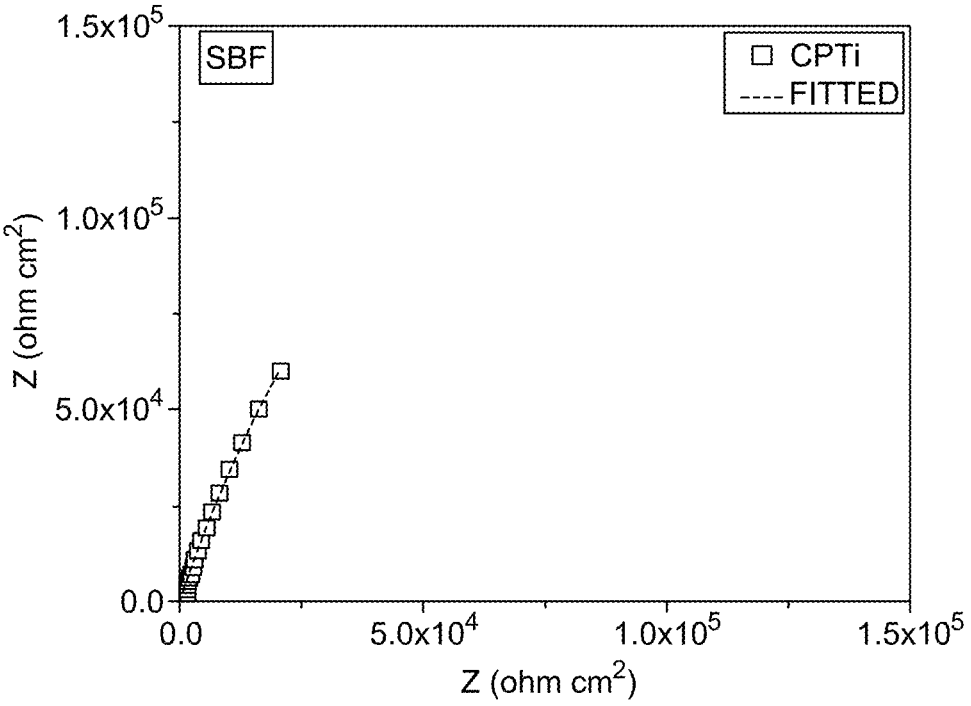
FIG. 11B shows the Nyquist plot of the CPTi tested in the SBF medium, according to certain embodiments.
Figure 11C:
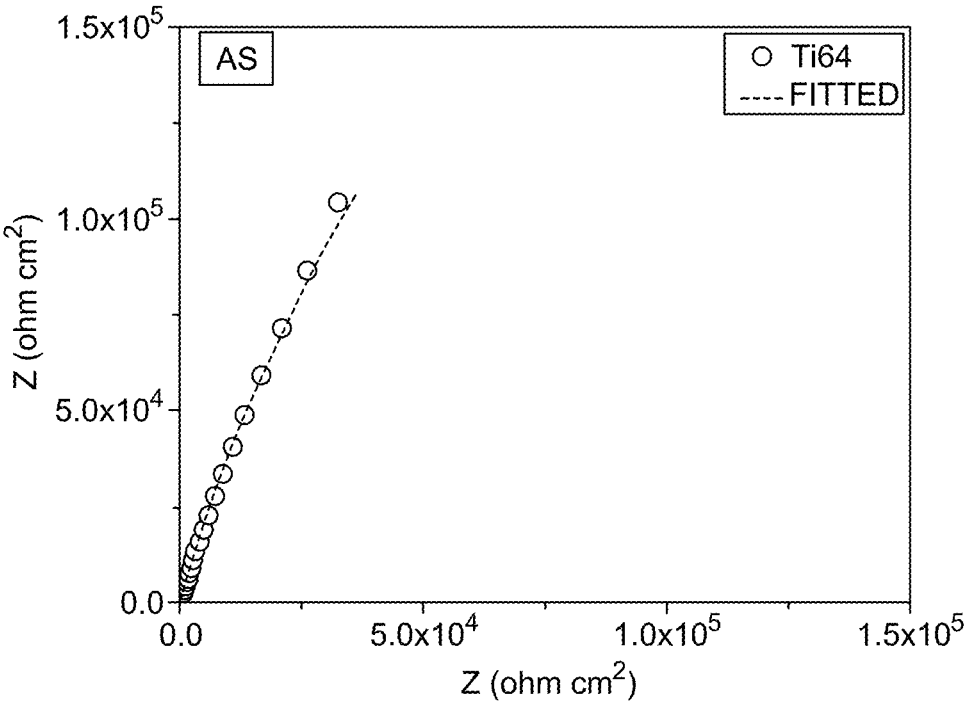
FIG. 11C shows the Nyquist plot of the Ti64 alloy tested in the AS medium, according to certain embodiments.
Figure 11D:
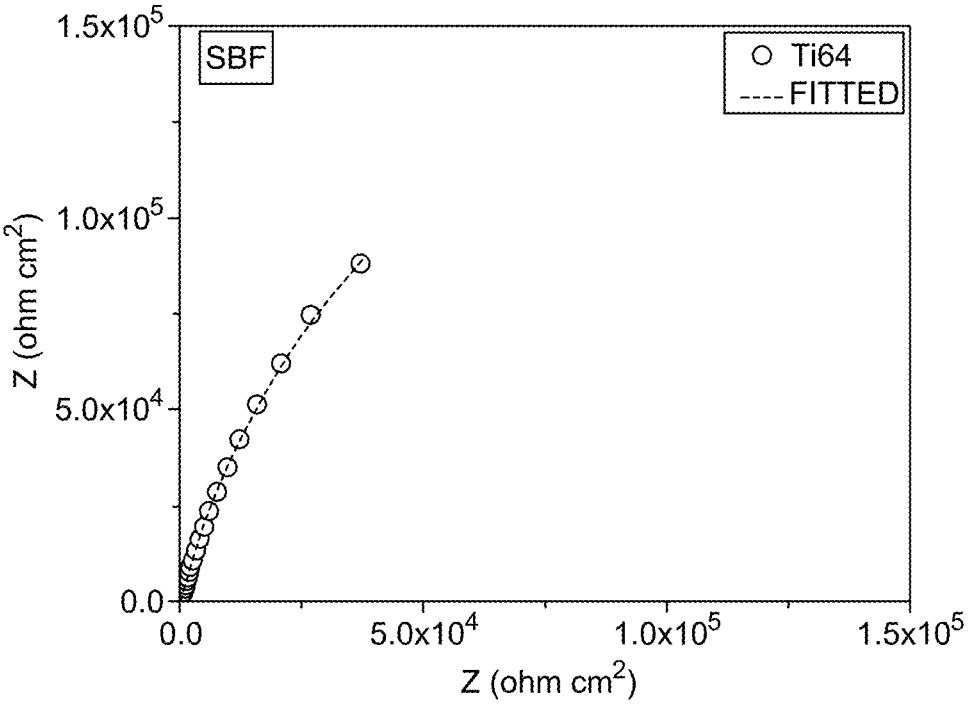
FIG. 11D shows the Nyquist plot of the Ti64 alloy tested in the SBF medium, according to certain embodiments.
Figure 11E:
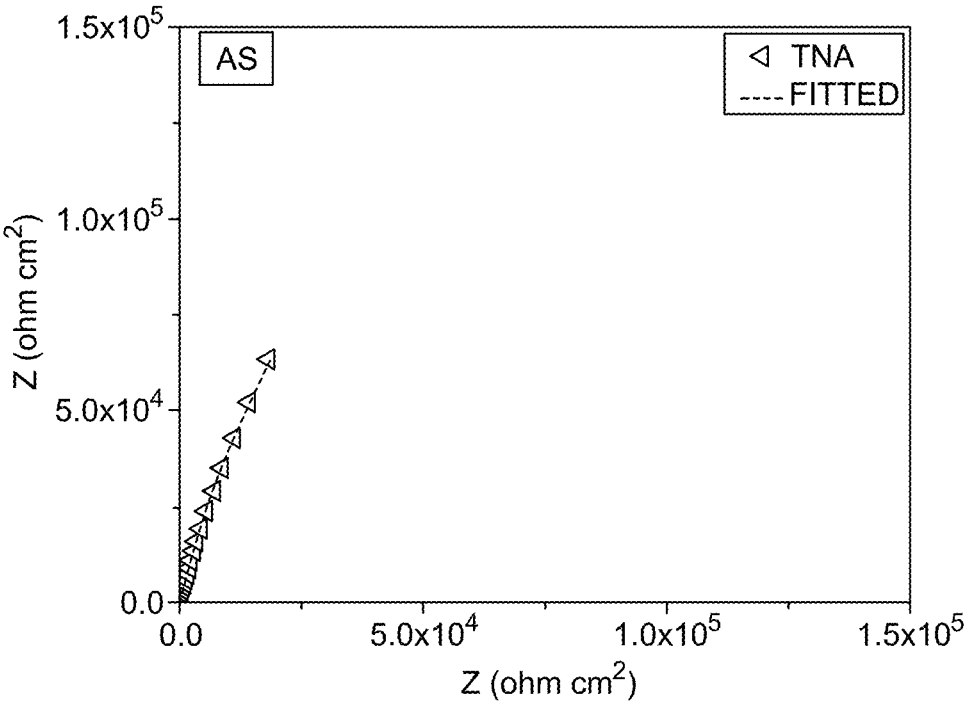
FIG. 11E shows the Nyquist plot of the TNA alloy tested in the AS medium, according to certain embodiments.
Figure 11F:
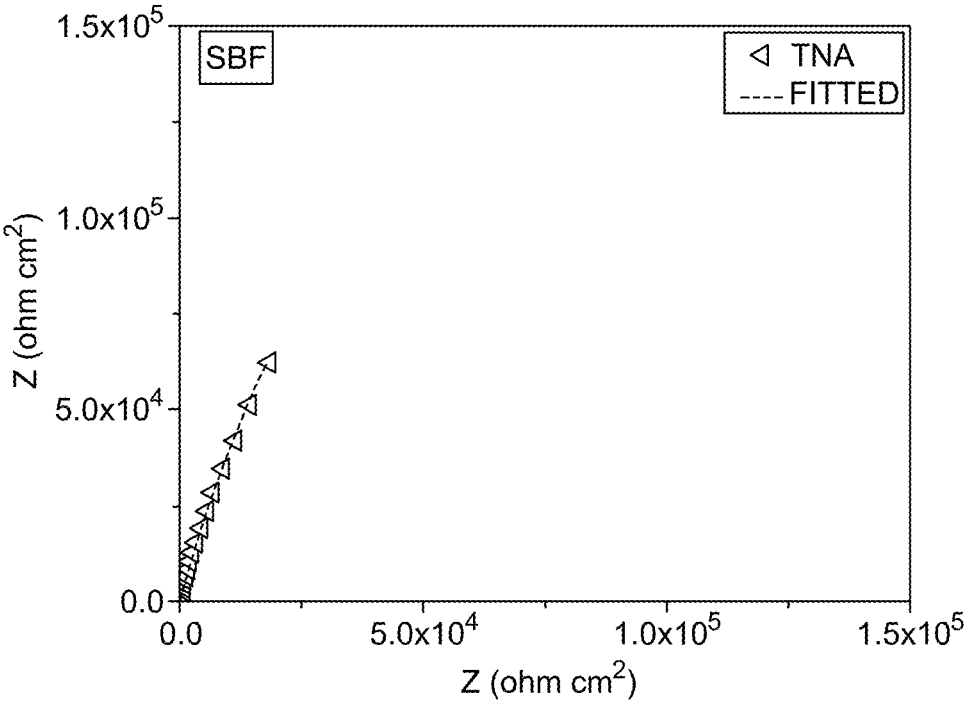
FIG. 11F shows the Nyquist plot of the TNA alloy tested in the SBF medium, according to certain embodiments.

FIG. 10 shows the PDP plots for the investigation of TNA alloy compared to CPTi and Ti64 alloy samples in different physiological mediums. Closer observation of cathodic branches of PDP curves indicated that there were no significant changes in both media, suggesting that the cathodic reactions occurring in both media are similar with different rates, while anodic branches exhibited significantly varied potential domains in both media. PDP plots of commercial alloys in both testing mediums presented the upright anodic slope at the early phases of anodic polarization, demonstrating the anodic dissolution at their surface. Further, the anodic slope was almost found to be vertical, with a minor slope at a potential higher than 250 mV. The observation of vertical anodic slope was perhaps accompanied by the passive layer which caused the low oxygen diffusion on their surface.

The PDP plot of the TNA alloy sample exhibited different behavior compared with the commercial alloys. The anodic slope of TNA alloy was less steep, indicating reduced anodic dissolution. Besides, unlike the commercial alloys, the TNA alloy showed a decreased current density in the section ranging from the start of anodic polarization to almost 2000 mV. Further, TNA alloy showed a widespread passive array in their anodic branches, validating a distinguishing passivation performance. Thus, these results indicated that the TNA alloy showed a passivation state in both mediums, whereas the commercial alloys showed an active-passive performance. A comparison of the PDP curves of the investigated samples thus suggested that for commercial alloys, artificial saliva (AS) is less aggressive than simulated body fluid (SBF); however, for TNA alloy there is no significant difference between the two electrolytes. PDP plots were further analyzed to calculate the passive current densities ($i_{pass}$) and corrosion potential ($E_{corr}$) and the obtained values are summarized in Table 4.

The nobler $E_{corr}$ along with the lower $i_{pass}$ is generally governed by improved corrosion resistance. From Table 4, the TNA alloy sample showed the highest $E_{corr}$ amongst investigated samples, revealing that the TNA alloy presents a higher corrosion resistance in terms of thermodynamics. In addition, the $i_{pass}$ is considered the most significant parameter in assessing the passive phenomenon of the alloys, and a lower $i_{pass}$ usually signifies a strong protecting oxide film. The $i_{pass}$ value of TNA was about one order magnitude lesser than that of commercial alloys in both investigated mediums, signifying the lower dissolution rate of the passive layer on the TNA alloy during the passivation process in comparison with the investigated commercial alloys.

FIG. 11 shows EIS curves of the TNA and commercial alloys in AS and SBF media. Nyquist plots (FIGS. 11A-11F) of all the investigated samples showed a distorted capacitance arc with linear-like behavior in both mediums, revealing that the passive film on the Ti surface interrupts the charge transfer processes at the metal/electrolyte interface.

Figure 12A:
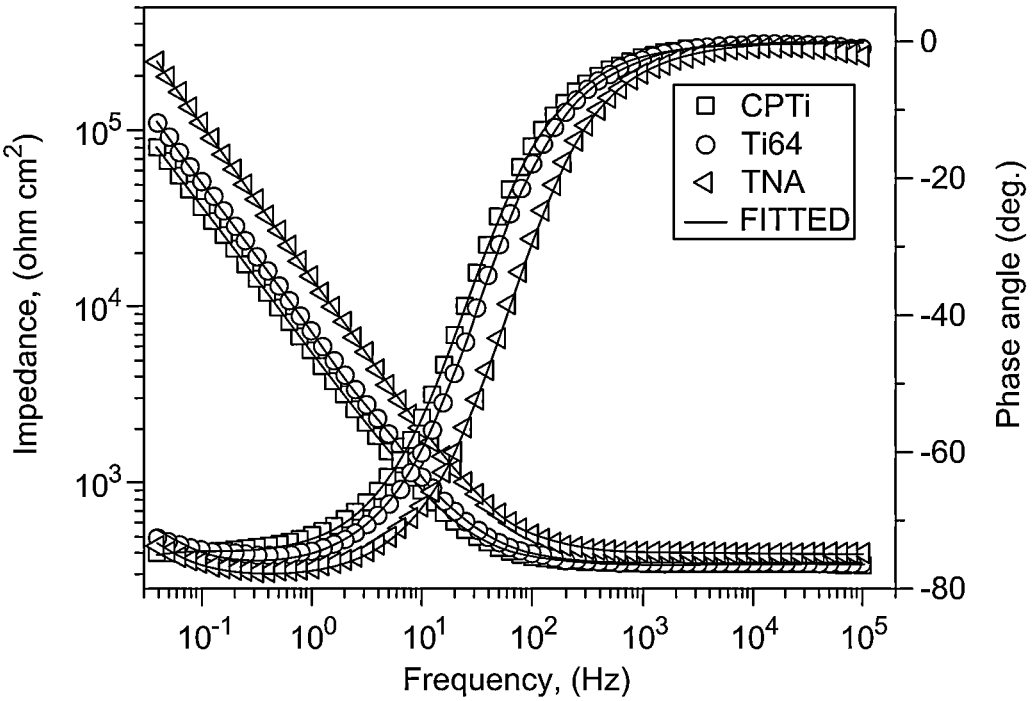
FIG. 12A shows a bode plot of the TNA alloy compared to the CPTi and the Ti64 alloy, tested in AS medium, according to certain embodiments.
Figure 12B:
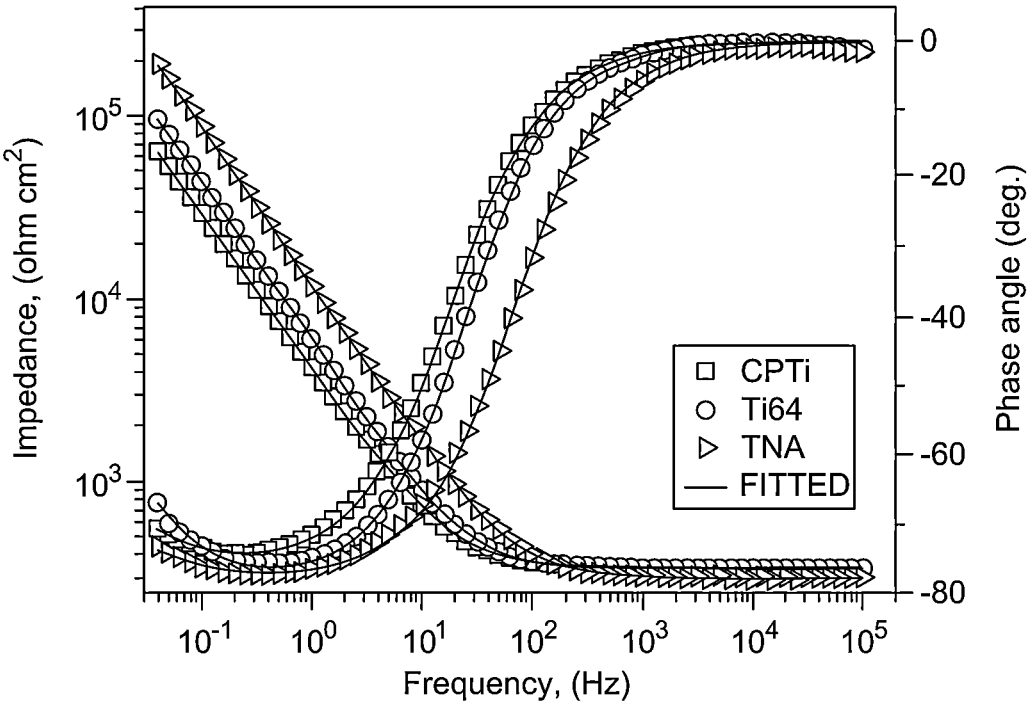
FIG. 12B shows the bode plots of the TNA alloy compared to the CPTi and the Ti64 alloy, tested in the SBF medium, according to certain embodiments.

FIG. 12 show Bode plots of the claimed TNA alloy in AS and SBF. The diameter of the capacitance arc was pointedly higher in AS compared to that in SBF. Hence, the corrosion resistance of the TNA alloy was found to be higher in AS, with a slightly lower performance observed in SBF. FIG. 12A shows a Bode plot of the TNA alloy compared to the CPTi and the Ti64 alloy, tested in AS medium; and FIG. 12B shows the bode plots of the TNA alloy compared to the CPTi and the Ti64 alloy, tested in the SBF medium. In the Bode illustration, all of the investigated samples showed only one time constant due to the single relaxation phenomenon, signifying the existence of the same electrochemical reactions on their surface in both mediums. The impedance values were observed almost the same at the higher frequencies for all the investigated samples, which were accompanied by the resistance offered by the solution. In the middle and lower frequencies, the EIS curves presented a linear behavior that was depending on the frequency; this result mainly indicated a capacitive performance at the interface between the metal and tested electrolytes. The impedance modulus for the TNA alloy specified the highest impedance value in the lower frequency section. In particular, the impedance values at lower frequencies were found to be observed on the order of $10^5$ ohm-square centimeters ($\Omega cm^2$), and the phase angle was observed at about −80° in both mediums. Generally, the higher impedance values and phase angles reaching −90° are distinctive features of capacitive characteristics, causing the enhanced corrosion resistance of the materials due to the passive film on their surface. Thus, the attained EIS results imply that the TNA alloy displayed effective resistance against corrosion in both AS and SBF media.

Further to entirely illustrate the impedance response of TNA alloy in terms of quantifiable comparisons against commercial alloys, a simple equivalent circuit (EC) model, $R_s[Q_{dl}R_{ct}]$, was used (FIGS. 11A-11F) for EIS circuit fit investigation. $R_s$ and $R_{ct}$ define the solution resistance and the charge transfer resistance of the samples, and $Q_{dl}$ shows double-layer capacitance. Instead of perfect capacitance (C) in the equivalent circuits, constant phase element (CPE) is utilized to compensate for the deviation from a perfect capacitor to a non-ideal performance. The calculated EIS values from the EIS analysis are shown in Table 4. Comparing the obtained impedance plots of investigated samples in AS and SBF, for commercial alloys, corrosion was pointedly found to be slower in AS than in SBF, while for TNA alloy, much less difference in the $R_{ct}$ values is identified between the two testing physiological mediums. The $R_{ct}$ values of the TNA alloy are pointedly greater than those of the commercial alloys. The greater value of TNA alloy improvement in corrosion resistance was mainly due to the existence of the compact passive film on the TNA alloy surface, which offered effective physical barrier protection. This distinctive was further approved by the decrease in the $Q_{dl}$ values, which was attributed to the suppressed infusion of violent species from the electrolytic mediums. In particular, the $R_{ct}$ value of the TNA alloy was slightly larger in AS compared to that in SBF. The corrosion resistance of the TNA alloy is unexpectedly good in light of the $Ti_2Ag$ precipitates that form on the surface. Typically, precipitates and other similar surface variations create opportunities to initiate corrosion. Additionally, the alloy of the present disclosure demonstrates excellent bacterial growth inhibition properties—making it ideal/suitable for implants. The TNA alloy is effective against gram +ve (*Staphylococcus aureus*), and gram −ve bacteria (*Escherichia coli*). Ag ion has a key influence on antibacterial performance, and the precipitation of $Ti_2Ag$ during contact sterilization governs the antibacterial performance of Ti—Ag alloys. The low elastic modulus of the TNA alloy of the present disclosure is also a superior match to bone compared to other known antibacterial alloys. Collectively, the TNA alloy of the present disclosure has numerous advantageous qualitied over other known alloys.

In some embodiments, the alloy can be used in a bioimplant. The alloy of the present disclosure can be used to form various implant stems, base plates and the like, including, for example, acetabular and femoral components of hip replacement implants; tibial and femoral components of knee replacement implants; tibial and femoral stems of knee replacements components of shoulder replacement implants; and non-articulating components of ankle and elbow replacement implants. Similarly, the alloys of the invention are also advantageously used to form fracture fixation devices and components such as nails, screws, and plates.

EXAMPLES

The following examples demonstrate an antimicrobial alloy, as described herein. The examples are provided solely for illustration and are not to be construed as limitations of the present disclosure, as many variations thereof are possible without departing from the spirit and scope of the present disclosure.

Microstructure and Phase Analysis

The phase compositions were determined using the XRD with a scanning rate of 2°/min from 20 to 90°. The microstructure was analyzed using a SEM using both secondary electron (SE) and backscattered electron (BSE) modes. Particle size, phase percentage, and grain size were determined using ImageJ software from SEM images of powders and sintered samples. Elemental analysis was characterized using EDX spectroscopy. Mapping was used to analyze the distribution of alloying elements. Samples for microscopic analysis were prepared using the standard preparation method by initially grinding the sample face using 240-1200 grit silicon carbide (SiC) abrasive followed by rough polishing using MetaDi 3 micrometers (μm) diamond suspension and finally fine polished using alumina suspension. Soon after polishing, the samples were dried and etched using (hydrogen fluoride (HF) 20%-80% water ($H_2O$)) for 10 seconds (sec).

Microhardness, Elastic Modulus, and Density Measurements

The hardness of Ti TNA alloy was evaluated using a Microhardness tester (NG-1000, NextGen, Canada). Vickers hardness is measured at 300-gram force (gf) load with a dwell time of 10 sec. Samples for hardness measurement were made flat and polished. The hardness value represents the average of 12 readings taken at least 1 mm apart on the sample in a straight line.

The elastic modulus was measured using micro-indentation. A 100 mN indentation load was applied at a rate of 200 mN/min with a 5 second pause time. A 3*3 matrix of indents were made the modulus values were calculated using the Oliver & Pharr method, [Oliver Warren Carl, Pharr George Mathews. An improved technique for determining hardness and elastic modulus using load and displacement sensing indentation experiments. J Mater Res 1992; 7 (6): 1564e83], incorporated herein.

Density was determined after sintering. Samples were ground and cleaned thoroughly before measuring the bulk density using high precision electronic densimeter (MDS-300, Alfa Mirage, Japan). The sample was weighed in air and then in water to automatically measure the sample density based on the Archimedes principle. The bulk densification percentage was calculated from the equation below:

$$(\rho_{ex} \text{ of uniaxially pressed powder mixture})/(\rho_{ex} \text{ of sintered alloy})\times 100,$$

wherein $$\rho_{ex} = (a/(a-b))*(\rho_L - \rho_a) + \rho_a,$$

where $\rho_{ex}$ is the measured density of the specimen, 'a' and 'b' are the weight of the specimen in air and water, respectively, '$\rho_L$' and '$\rho_a$' are the density of water and air, respectively. The porosity of TNA samples was determined by subtracting the bulk densification percentage from 100, i.e., porosity=100–[bulk densification %].

Antibacterial Properties

Antibacterial activities were evaluated qualitatively using the agar diffusion method. Gram-positive (G+ve) bacteria *Staphylococcus aureus* (ATCC43300) and Gram-negative (G–ve) bacteria *Escherichia coli* (ATCC8739) were used in the present study to test samples of the developed TNA alloy, relative to commercial Ti64 alloy (control 1), and commercial CPTi (control-2). Bacterial colonies from an agar plate were incubated overnight at 37° C. in Luria-Bertani (LB) medium. The overnight bacterial culture was diluted to approximately 105 colony-forming units (CFU) per millilitre with sterile phosphate-buffered saline (PBS) solution. One hundred microliters of bacterial suspension were spread on an LB-agar plate, and sterile forceps were used to place samples to be tested on the agar. The samples were then incubated overnight at 37° C. on agar plates. Following incubation, the inhibition zone was analysed. The antibacterial inhibition efficacy was measured quantitatively using a modified method. 1 ml of a bacterial suspension in PBS solution containing approximately 105 CFU ml–1 was added to a sterile petri dish containing 9 mL of LB medium and the sample, which was then incubated at 37° C. for 48 hours while shaking at 100 rpm. After incubation, 100 microlitres (μl) of bacterial culture was extracted from each disk, and serial dilutions with PSB solution were repeated with each primary sample. After spreading 100 μl of sample diluent onto solid LB agar plates at 37° C. for 48 hours, the number of viable cells was manually calculated and multiplied by the dilution factor. There were three replicates for each sample.

The following formula was used to calculate sample inhibition efficiency rates:

$$\text{Inhibition efficiency rates } (\%) = (N0-N)/N0\times 100,$$

where N0 and N represent the average number of CFUs in control and TNA alloy samples, respectively.

In Vitro Corrosion Study in SBF and AS Mediums

In vitro corrosion performance of TNA alloy samples were inspected in artificial saliva (AS) and simulated body fluid (SBF) using the Gamry Reference electrochemical workstation. The AS and SBF solution were prepared as explained previously. Three electrode cell assembly was utilized, in which TNA alloy with an exposure area of 1.76 square centimeters ($cm^2$) acted as the working electrode, whereas saturated calomel (SCE) and graphite rod performed as a reference and counter electrodes, respectively. Open circuit potential (OCP) was monitored for 30 minutes (mins) before performing any electrochemical experiments to attain stable equilibrium. Electrochemical impedance spectroscopic (EIS) tests at OCP were done using the frequency region of 1 KHz to 1 mHz with 10 millivolts (mV) amplitude. The potentiodynamic polarization (PDP) curves of the TNA alloy samples were obtained from 0.250 vs OCP to 2 V vs SCE, with a scan rate of 0.1667 mV/s. All the corrosion tests were investigated by the Echem analysis software and replicated a minimum of three times to validate the reproducibility of the obtained data.

Example 1: Processing of Titanium (Ti)-Nobium (Nb)-Silver (Ag) (TNA) Alloy

The elementary powders were weighed and prepared in an at % of Ti-30Nb-3Ag before being blended in a WC vial for two hours at 250 rpm in a Planetary Micro Mill PULVERISETTE 7 under a high purity argon atmosphere. The blended powder was pressed uniaxially at 550 MPa in a 20 mm die. The compacted powder was sintered under high-purity argon in a tube furnace (GSL-1700X. MTI) at a heating rate of 10° C./min to a temperature of 1100° C. 1200° C. and 1300° C. and then held isothermally for 2 hours.

Table 1 shows the chemical composition of the TNA alloy of Example 1.

| Element | Nb | Ag | Ti |
|---|---|---|---|
| At. % | 30 | 3 | 67.00 |
| Wt. % | 44.12 | 5.12 | 50.76 |

TABLE 2

Density and porosity of TNA alloys

| Sintering Temperature (° C.) | Measured Density ($g/cm^3$) | Densification (%) | Porosity (100 − densification %) |
|---|---|---|---|
| 1100 | 5.10 | 86.19 | 13.8 |
| 1200 | 5.29 | 89.28 | 10.7 |
| 1300 | 5.31 | 89.69 | 10.3 |

TABLE 3

Measured elastic modulus and microhardness values

| Sample | E (GPa) | HV | HV (GPa) |
|---|---|---|---|
| TNA-1100 | 68.4 ± 6 | 274.5 ± 7 | 2.692 ± 0.06 |
| TNA-1200 | 64.7 ± 10 | 238.9 ± 9 | 2.343 ± 0.08 |
| TNA-1300 | 80 ± 4.9 | 279.6 ± 8 | 2.742 ± 0.07 |
| CP-Ti | 105 | 155 | 1.52 |
| Ti—6Al—4V | 112 | 349 | 3.75 |
| Cortical bone | 17-20 | 40.4 | 0.4 |
| Ti—12Mo | 111 | 360 | 3.53 |
| Ti—20Mo | 127 | 310 | 3.04 |
| Ti—13Nb—13Zr—13Ag | 75-87 | 335-370 | 3.28-3.63 |

The antimicrobial alloy of Example 1 has a predominantly (53%) beta-titanium crystal structure as measured by SEM. Table 1 summarizes the at % and corresponding wt % of TNA alloy Example 1. Table 2 summarizes the relationship between sintering temperature and density, densification percentage, and porosity for TNA alloy Example 1. Increasing the sintering temperature leads to increased alloy density and densification percentage, and decreased porosity. Table 3 summarizes the elastic modulus, and microhardness of the antibacterial alloy of Example 1. Example 1 has an elasticity modulus ranging from 60 to 85 gigapascals (GPa), The bacterial growth inhibition results shown in FIG. 9 indicate that the antibacterial alloy of Example 1 inhibited Gram (+) bacteria growth by about 85% compared to the reference and Gram (−) bacteria growth by about 88% compared to the reference.

The parameters of electrochemical corrosion resistance tests and results are summarized in Table 4. The TNA alloy has a corrosion potential voltage ranging from −0.130 and −0.150 volts (V), particularly about −0.149 V. The corrosion resistance of the antibacterial alloy of Example 1 was superior as evidenced by the lower $E_{corr}$ potential and lower impedance values.

Collectively, the TNA alloy of the present disclosure possesses a number of advantageous properties that make the TNA alloy of the present disclosure an excellent candidate for surgical implants. The lower elastic modulus is a better match to the elastic modulus of bone compared to other disclosed alloys. The antibacterial inhibition properties will reduce the likelihood of post-implantation infections. Finally, the superior corrosion resistance of the TNA alloy of the present disclosure indicates that surgical implants made from the disclosed alloy are less likely to degrade than conventional alloys.

Numerous modifications and variations of the present disclosure are possible in light of the above teachings. It is therefore to be understood that within the scope of the appended claims, the invention may be practiced otherwise than as specifically described herein.

The invention claimed is:

1. An antimicrobial alloy, comprising:

titanium, niobium, and silver; wherein the alloy comprises between 5 and 30 atomic percent niobium, up to 3 atomic percent silver and between 67 and 94.9 atomic percent titanium, wherein atomic percent is calculated based on the total number of Ti, Nb and Ag atoms;

wherein the alloy does not comprise zirconium; and wherein the antimicrobial alloy has at least 51 percent beta-titanium crystal structure, determined by scanning electron microscope image analysis, and an elasticity modulus ranging from 60 to 85 GPa as measured according to ASTM E111, wherein the alloy has a bulk densification percentage, given by the following expression;

$$(\rho_{ex} \text{ of uniaxially pressed powder mixture})/(\rho_{ex} \text{ of sintered alloy})\times 100$$

that ranges from 80.0 to 95.0%, wherein $\rho_{ex}$ is calculated according to the equation $$\rho_{ex}(a/(a-b)*(p_L-\rho_a)+\rho_a$$

wherein $\rho_{ex}$ is the measured density of the specimen as measured by a densimeter, 'a' and 'b' are the weight of the specimen in air and water, respectively, and '$\rho_L$' and '$\rho_a$' are the density of water and air, respectively.

2. The antimicrobial alloy of claim 1 wherein the bulk densification percentage ranges from 89.3 to 89.7%.

TABLE 4

Electrochemical parameters of TNA alloy compared to CPTi and Ti64 alloy in different physiological mediums

| Testing medium | Sample | $E_{corr}$ (V) | $i_{pass}$ (μA $cm^{-2}$) | Rs (Ω $cm^2$) | Rct (kΩ $cm^2$) | CPEdl (μ$\Omega^{-1}$ · $cm^{-2}$ · sn) | ndl |
|---|---|---|---|---|---|---|---|
| As | CPTi | −0.204 | 29.871 | 212.5 | 77.802 | 11.865 | 0.98 |
| | Ti64 | −0.135 | 8.987 | 186.52 | 112.63 | 1.568 | 0.97 |
| | TNA | −0.11 | 0.301 | 204.55 | 258.649 | 0.145 | 0.99 |
| SBF | CPTi | −0.221 | 38.895 | 208.1 | 63.576 | 18.654 | 0.96 |
| | Ti64 | −0.139 | 10.442 | 195.64 | 107.215 | 5.264 | 0.96 |
| | TNA | −0.102 | 0.348 | 199.53 | 212.587 | 0.289 | 0.98 |

3. The antimicrobial alloy of claim 1 wherein the alloy has a microhardness ranging from 2.692 to 2.742 GP according to ASTM E384.

4. The antimicrobial alloy of claim 1 wherein the alloy has an elasticity modulus of about 80 GPa as measured according to ASTM E111.

5. The antimicrobial alloy of claim 1 wherein the alloy has a corrosion potential voltage ranging from −0.130 and −0.150 V as measured using electrochemical impedance spectroscopy in at least one of the group consisting of artificial saliva and simulated body fluid.

6. The antimicrobial alloy of claim 1 wherein said alloy inhibits gram-positive bacteria growth by at least 85 percent as measured by agar diffusion according to the equation $$\text{Inhibition efficiency rates } (\%) = (N0-N)/N0 \times 100$$

wherein N0 and N represent the average number of colony forming units in control and said alloy-treated samples, respectively.

* * * * *